US008342978B2

(12) United States Patent
Tamura

(10) Patent No.: US 8,342,978 B2
(45) Date of Patent: Jan. 1, 2013

(54) DEVICE FOR INSTRUCTING DOWNSWING IN GOLF SWING

(76) Inventor: Kunihiro Tamura, Tokyo (JP)

( * ) Notice: Subject to any disclaimer, the term of this patent is extended or adjusted under 35 U.S.C. 154(b) by 247 days.

(21) Appl. No.: 12/657,567

(22) Filed: Jan. 25, 2010

(65) Prior Publication Data

US 2012/0108351 A1 May 3, 2012

(51) Int. Cl.
*A63B 57/00* (2006.01)

(52) U.S. Cl. ..... 473/212; 473/213; 473/215; 473/216; 473/226; 463/7; 463/30

(58) Field of Classification Search ..... 473/219
See application file for complete search history.

(56) References Cited

U.S. PATENT DOCUMENTS 5,558,519 A * 9/1996 Sabowitz ..... 434/247
2007/0135225 A1* 6/2007 Nieminen et al. ..... 473/212

FOREIGN PATENT DOCUMENTS

JP 06238025 A * 8/1994

OTHER PUBLICATIONS

Plagenhoef, Stanley, "Golf Research Projects", 1983.*
"ISBS—Conference Proceeding Archive", 1983.*

* cited by examiner

*Primary Examiner* — David L Lewis
*Assistant Examiner* — Werner Garner
(74) *Attorney, Agent, or Firm* — Westerman, Hattori, Daniels & Adrian, LLP

(57) ABSTRACT

A start timing instructing device includes a sensor attachable to the body of a player to detect changes in angle and/or acceleration associated with a backswing movement of the player. A variable resistor sets a start timing associated with a predetermined angle and/or acceleration data and has a volume by which the set start timing is adjustable. A microprocessor calculates an angle and/or acceleration data of the backswing movement based on the detected angle and/or acceleration and generates a start timing instruction if the calculated angle and/or acceleration data meet the angle and/or acceleration data which have been set and adjusted through the variable resistor and the volume. The microprocessor controls a stimulator attached to the body of the player to generate a vibration, sound or electric stimulation upon receiving the start timing instruction so as to inform the player of the body start timing for the downswing.

10 Claims, 12 Drawing Sheets

DEVICE FOR INSTRUCTING DOWNSWING IN GOLF SWING

FIELD OF THE INVENTION

The present invention provides an exercise instructing device which uses computer software for the timing of the downswing in a golf swing. It measures the swing with sensors and analyzes it by computer. In the golf swing which is performed by starting from the backswing after addressing the ball and continuing through the downswing, a part of the kinetic energy generated by the returning from being twisted of the upper and lower limbs and a part of the potential energy generated from the gravitation field when a golf club is swung down are applied to the ball from the club head according to the cumulative adding of forces, and energy applied to a ball at impact is defined by the physical properties of the club, the ball and physical law. Hence, it is difficult to artificially control the energy and hence, it is difficult to learn a technique to obtain maximum swing efficiency. An exercise instructing device according to the present invention assists the user in a hitting exercise implementing information processing technology which uses information input by means of motion perception by adjusting the timing of the swing to start with the lower limbs while the upper limbs are in the vicinity of the top of the swing using sensors, a microcomputer and variable resistors individually for each player.

BACKGROUND OF THE INVENTION

Conventional golf swing training machines include machines which conduct the downswing (for example, see patent document 1). They provide a ball hitting action training machine to obtain stability in hitting (for example, see patent document 2) and in addition, as they may be "action analyzing training machines", disclosed in patent document 3. The "action training machines" photograph the player's form, etc. with a camera and allow the player to correct his/her form by recognizing differences between his/her own form and the ideal form by repeating slow-motion replay, stop-motion replay, etc. Further, a method as disclosed in the publication of patent document 4 has been developed, in which the player's golf swing form is photographed with a camera and, while tracking a specific part of the player's body, for example, the center of the forehead, as a target using pattern recognition, a wave pattern of the trajectory and a video image of the swing form are synthesized and the synthesized image is displayed, and correcting training machines are disclosed in the publication of patent documents 5, 6, etc.

PATENT DOCUMENT

1. Japan published unexamined application 1994-238025
2. Japan published unexamined application 1994-63209
3. Japan published unexamined utility model application 1989-101572
4. Japan published unexamined application 1991-295574
5. Japan published unexamined application 1991-12182
6. Japan published unexamined application 1996-173586

Non-patent document "Sensor-Internet Technology changes Future Sports Coaching" by Yuji Ohgi, Associate Professor, Keio University Training products include "Swing Magic" (trademark), "Tempo Master Driver" (trademark, product of M.I.T. Inc.), "Power Max Fitness Swing Machine" (trademark), "Medicus" (trademark, product of Robert Golf Company), "V603SH/golf played by swinging mobile phone" (product of Vodafone-SHARP), "SUUNTO G6 PRO/wristwatch-shaped swing measuring device" (trademark, product of SUUNTO), "Smart Swing" (trademark), "Wii" (trademark, product of Nintendo Co., Ltd.), etc., and the present patent relates to a technique in which computer software instructs separately to start the downswing with the lower limbs.

SUMMARY OF THE INVENTION

According to a first aspect of the present invention, a start timing instructing device for informing a player of a body start timing for downswing in a golf swing includes a sensor, an A/D convertor, a variable resistor, a microprocessor, and a stimulator. The sensor is attachable to a golf club, a wrist, or a waist of the player and is configured to detect changes in angle and/or acceleration associated with a backswing movement of the player. The A/D convertor converts the detected angle and/or acceleration changes to a signal data. The variable resistor sets a start timing associated with a predetermined angle and/or acceleration data. The variable resistor has a volume by which the set start timing is adjustable. The microprocessor is configured to calculate an angle and/or acceleration data of the backswing movement based on the signal data received from the A/D convertor. The microprocessor is further configured to generate a start timing instruction if the calculated angle and/or acceleration data meet the angle and/or acceleration data which have been set and adjusted through the variable resistor and the volume. The stimulator is attachable to the player and configured to inform the player of the body start timing for the downswing by generating a vibration, sound or electric stimulation according to the start timing instruction received from the microprocessor.

In the downswing start timing instructing device, the sensor may include at least one of an angle velocity sensor, an acceleration sensor, and an angle and acceleration sensor. The device may further include a wristwatch-type device attachable to the wrist of the player. The wristwatch-type device has at least one of an angle velocity sensor, an acceleration sensor, and an angle and acceleration sensor. The microprocessor may execute steps specified in the computer program lists (A), (B), and/or (C) described below to determine the start timing. The start timing may be adjustable through the variable resistor so as to instruct the player to start the body movement toward the downswing immediately before the player finishes the backswing. The stimulator may be a vibrator attachable to a thigh of the player to stimulate the thigh with the vibration so as to instruct the player to start the body movement from the lower body of the player. The stimulator may receive the start timing instruction from the microprocessor via a wireless communication between the stimulator and the microprocessor.

According to a second aspect of the present invention, a method of informing a player of a body start timing for downswing in a golf swing includes (i) attaching a sensor to a golf club, a wrist, or a waist of the player to detect changes in angle and/or acceleration associated with a backswing movement of the player, (ii) converting the detected angle and/or acceleration changes to a signal data, (iii) calculating an angle and/or acceleration data of the backswing movement based on the signal data, (iv) attaching a stimulator to the player, (v) setting a start timing associated with an predetermined angle and/or acceleration data by a variable resistor and adjusting the set start timing through a volume of the variable resistor, (vi) generating a start timing instruction if the calculated angle and/or acceleration data meet the angle and/or acceleration data which have been set and adjusted through the variable resistor and the volume, and (vii) controlling the stimulator to generate a vibration, sound or electric stimulation to inform the player of the body start timing for the downswing according to the start timing instruction.

In the method, at least one of at least one of an angle velocity sensor, an acceleration sensor, and an angle and acceleration sensor may be attached to the player as the sensor. The sensor may be attached to the wrist of the player. The body start timing may be adjusted to instruct the player to start the body movement immediately before the player finishes the backswing. The stimulator may be attached to a thigh of the player to stimulate the thigh with the vibration to start the body movement from the lower body of the player. The start timing instruction may be sent to the stimulator via a wireless communication.

DETAILED DESCRIPTION OF THE INVENTION

Figure 1:
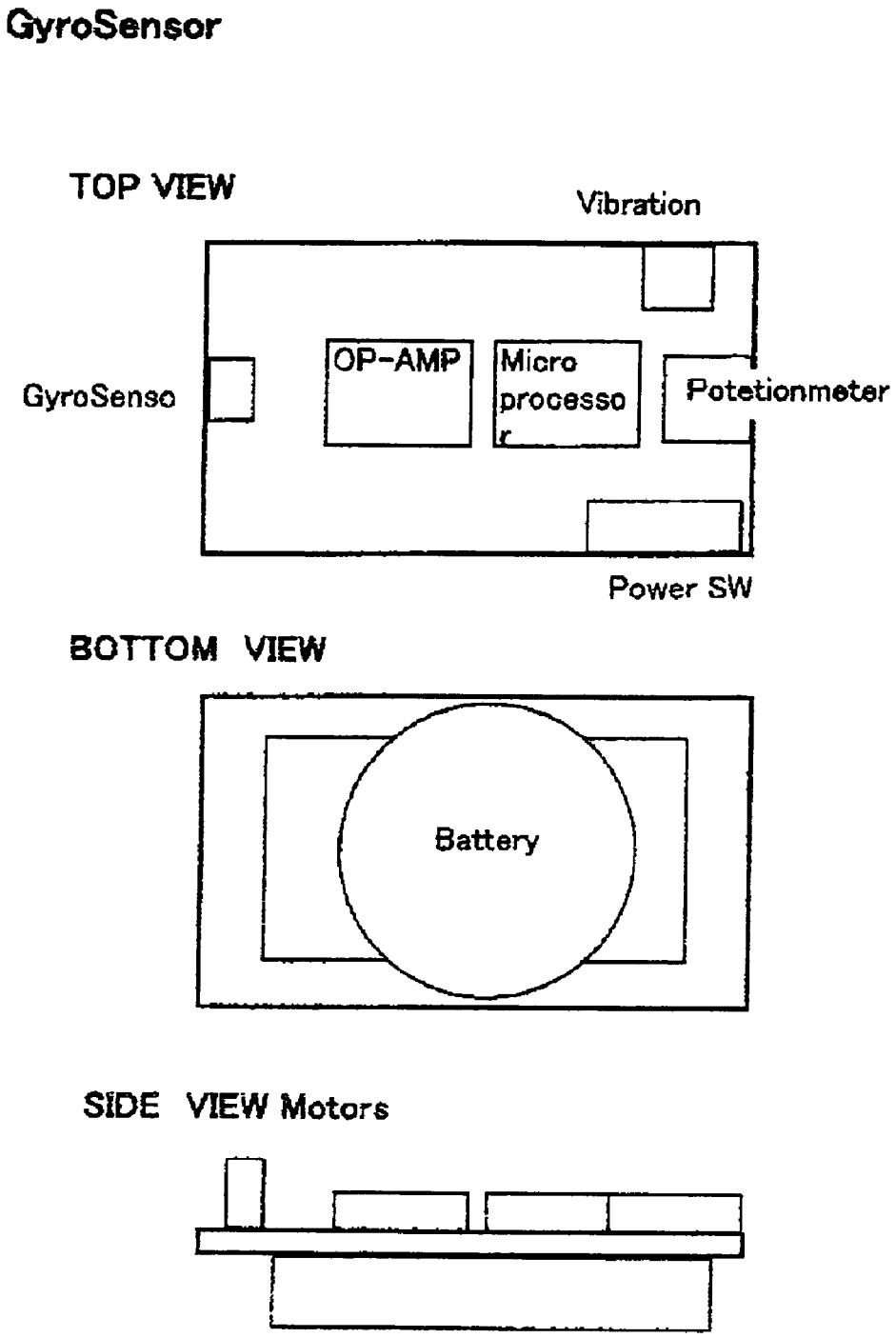
FIG. 1 shows a top, bottom, and side views of a gyro sensor (an angular velocity sensor) of a start timing instructing device according to the present invention.
Figure 2:
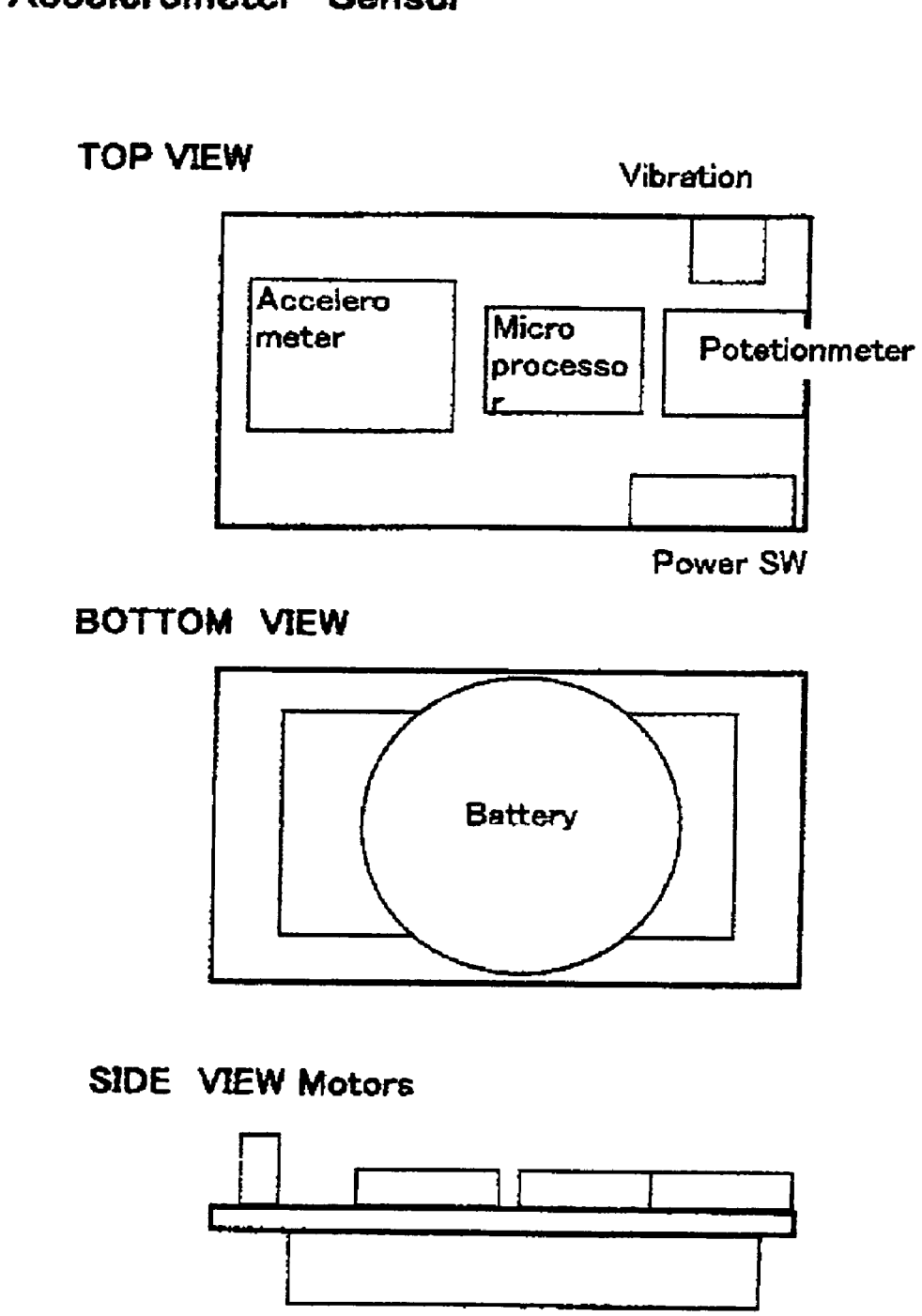
FIG. 2 shows a top, bottom, and side views of an acceleration sensor of a start timing instructing device according to the present invention.
Figure 3:
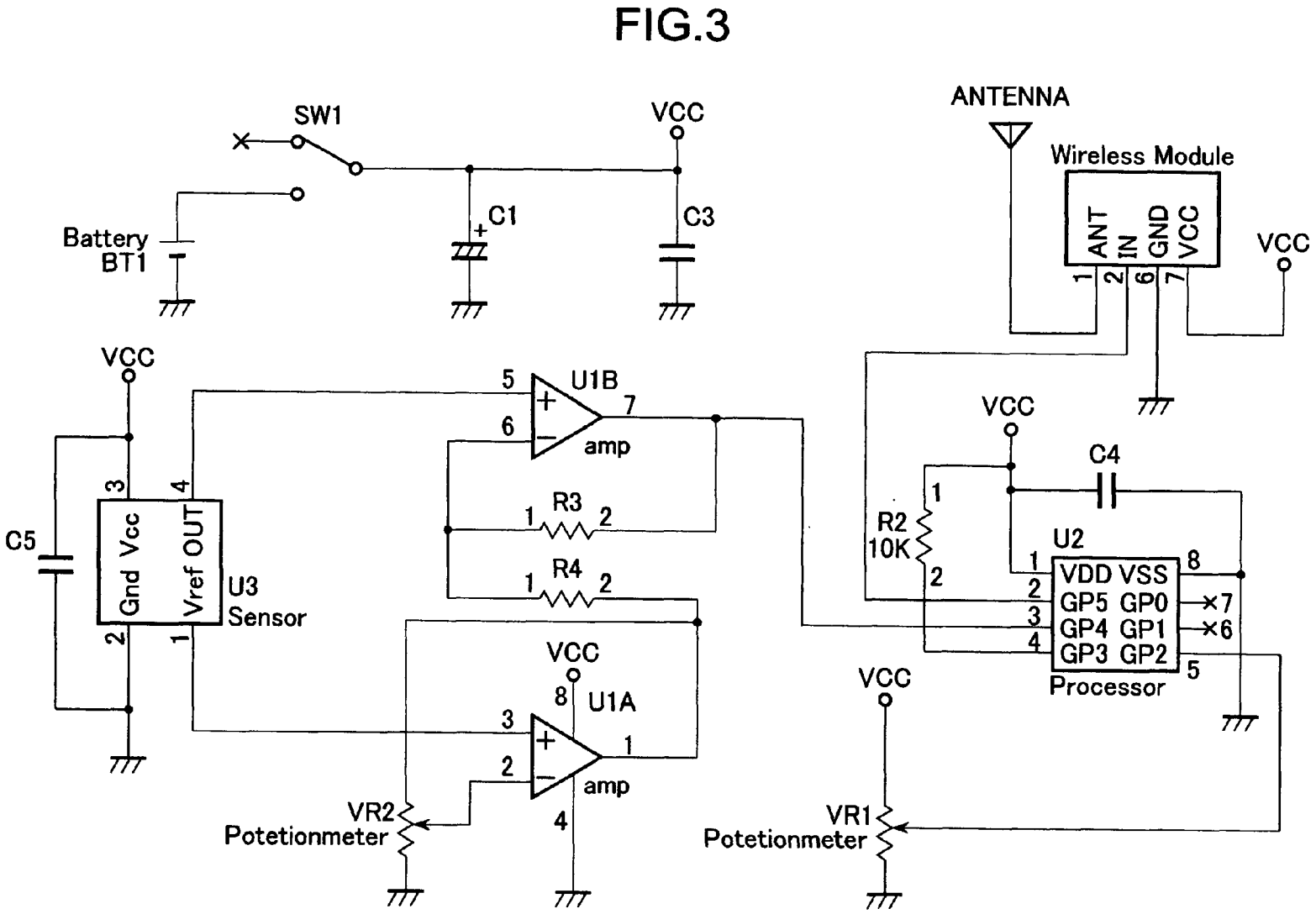
FIG. 3 shows a detection connection diagram for an angular velocity sensor.
Figure 4:
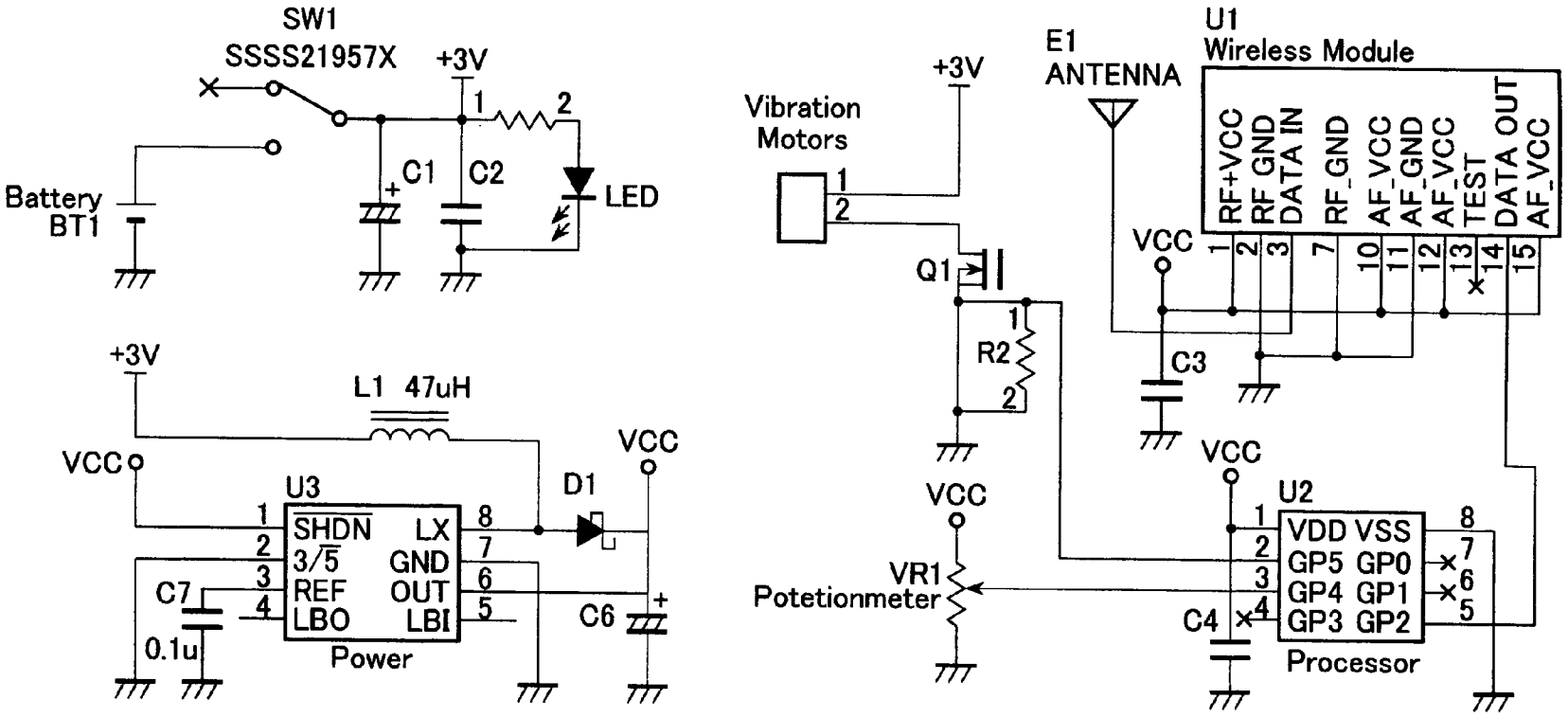
FIG. 4 shows a reception detection connection diagram.
Figure 5:
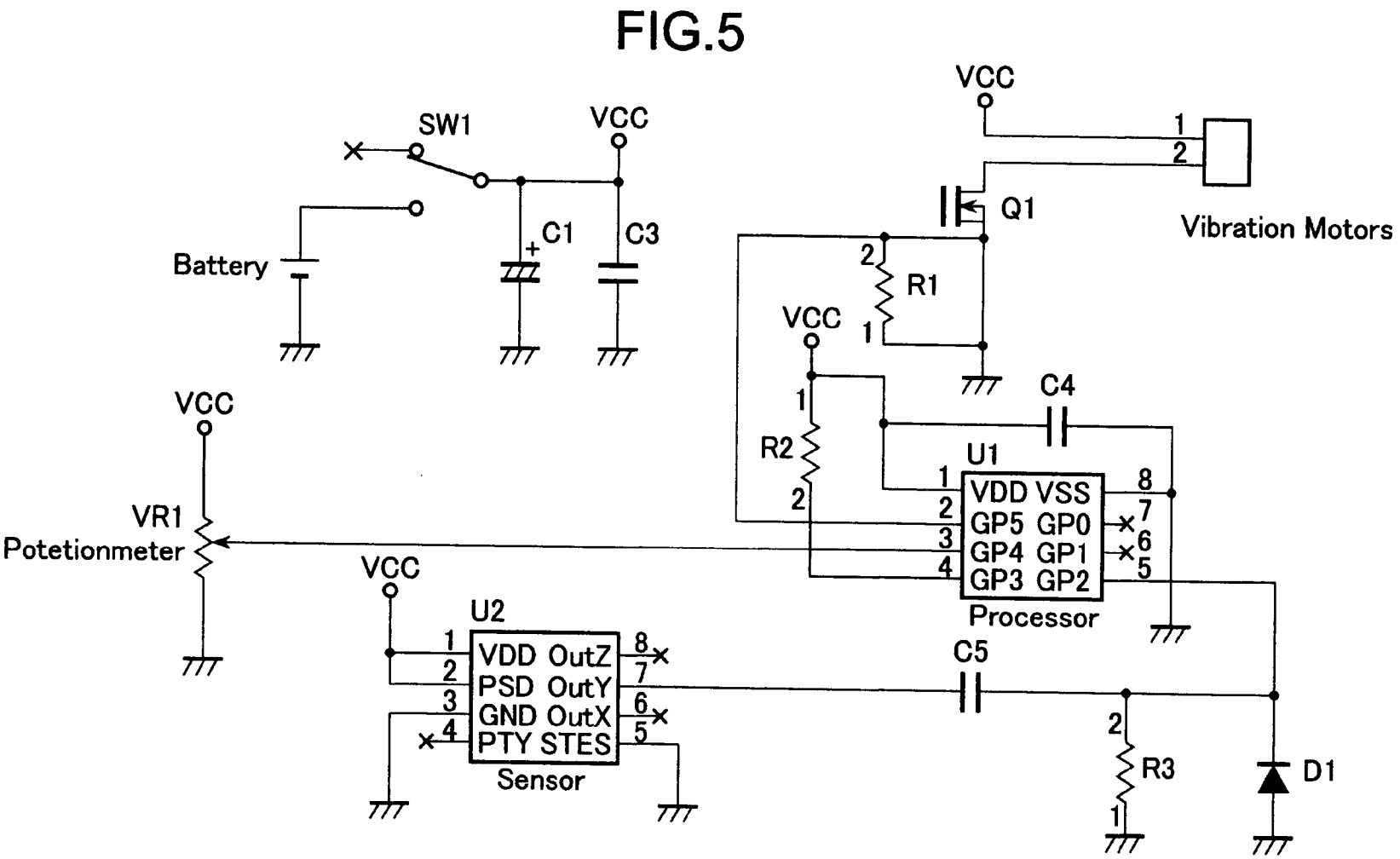
FIG. 5 shows a detection connection diagram for an acceleration sensor.
Figure 6:
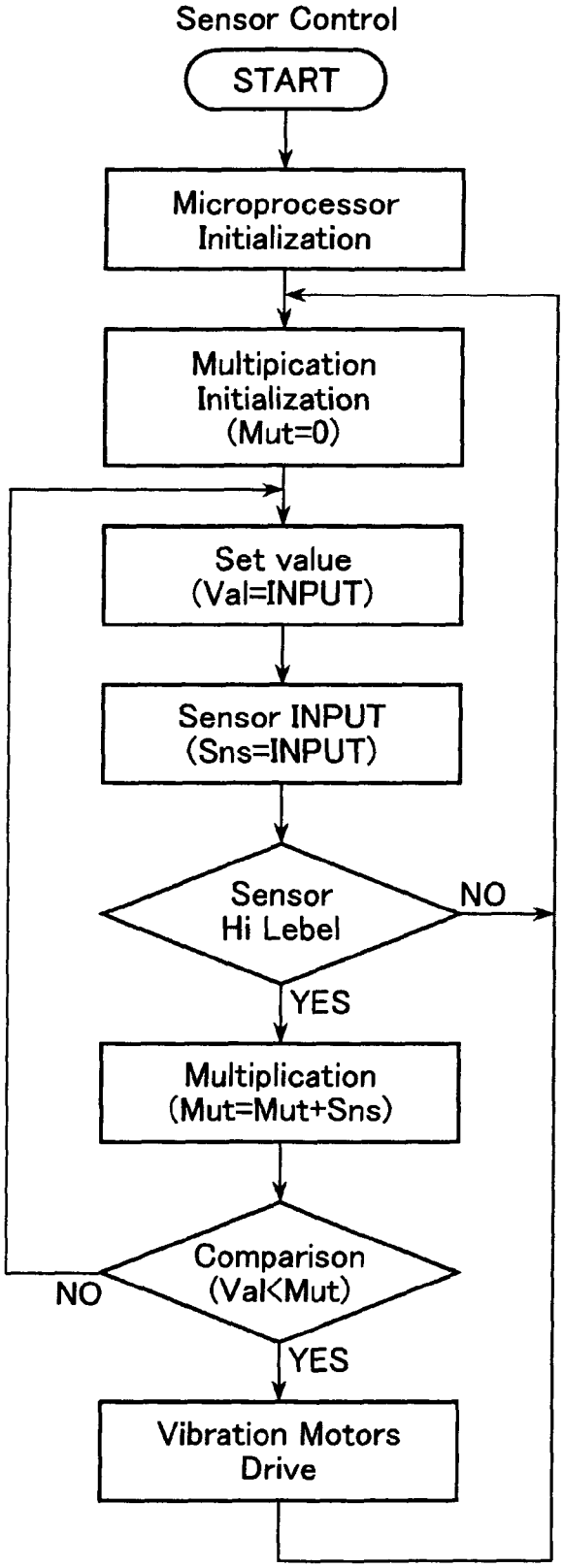
FIG. 6 is a flowchart for the sensor control.
Figure 7:
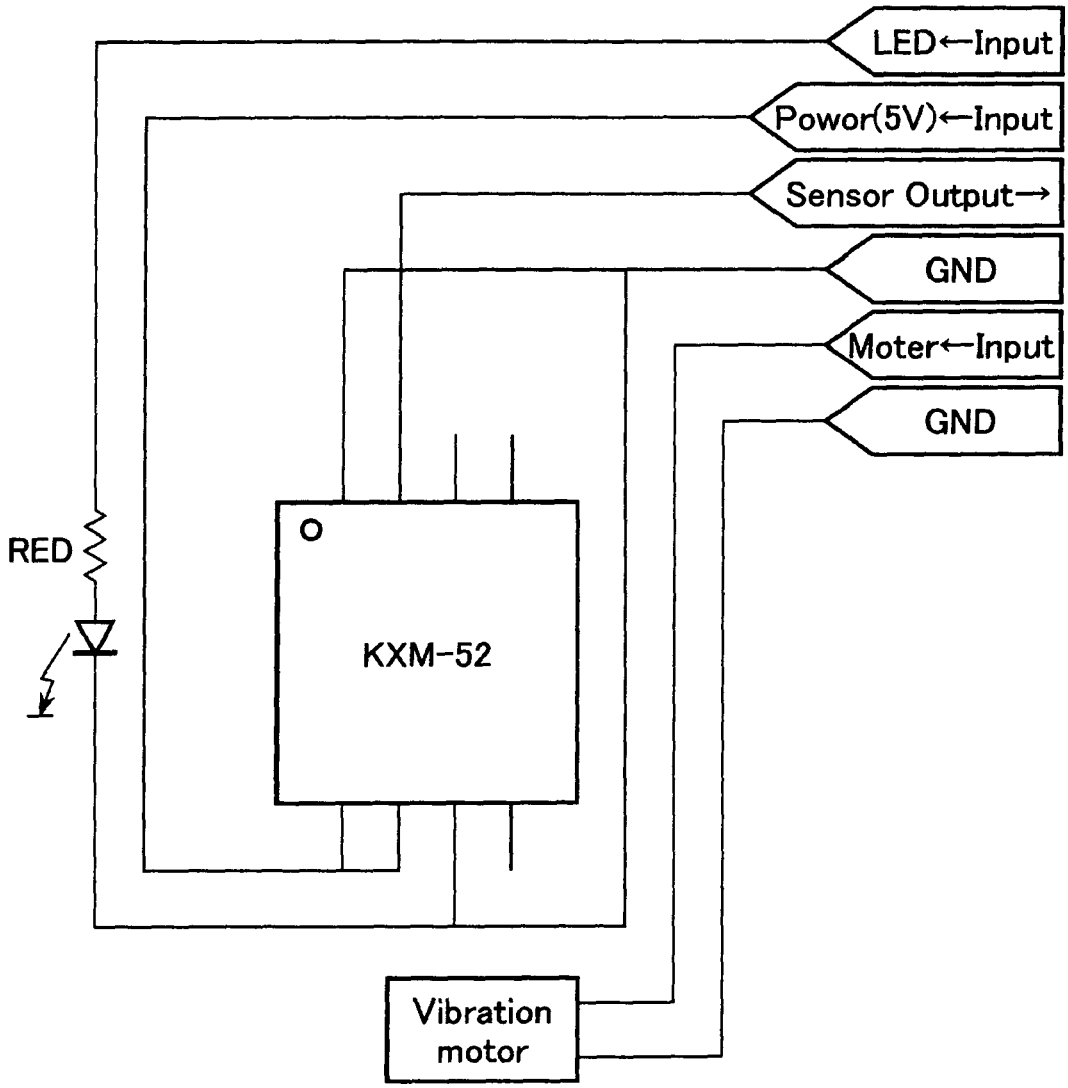
FIG. 7 shows a configuration diagram of an acceleration sensor.
Figure 8:
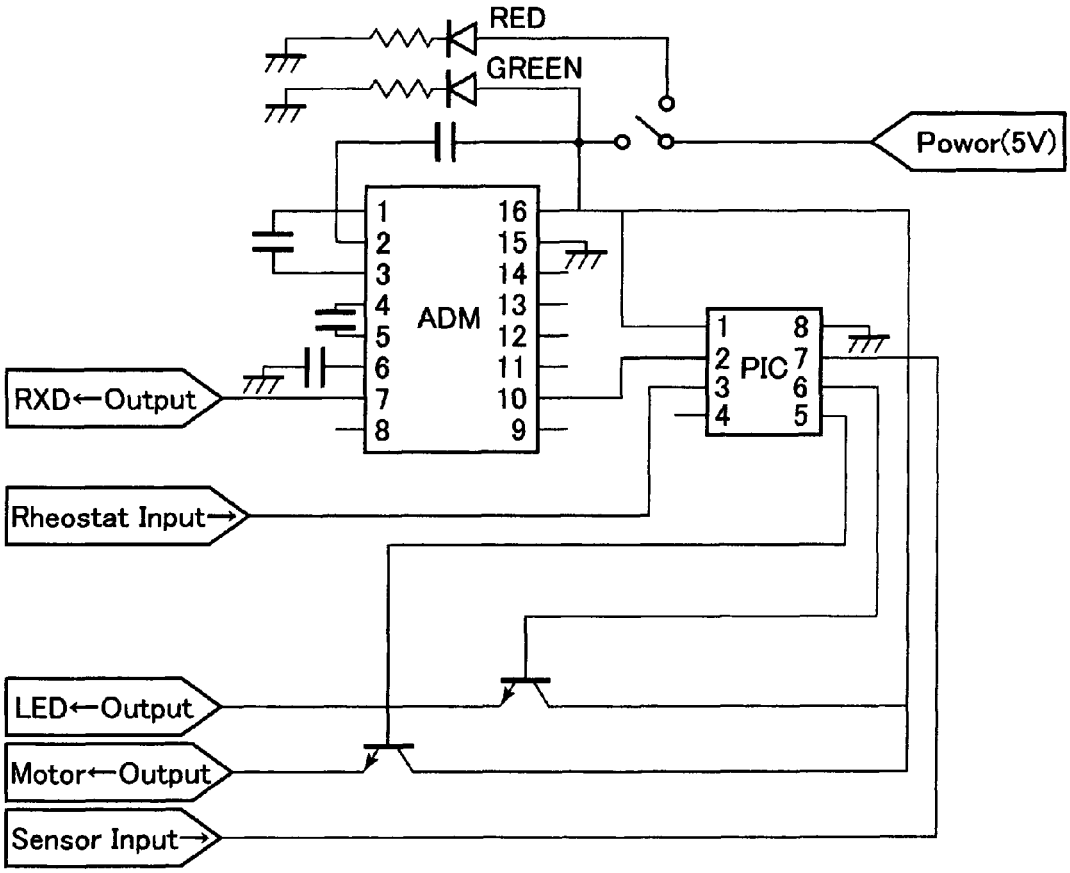
FIG. 8 shows a measurer/controller configuration diagram.
Figure 9:
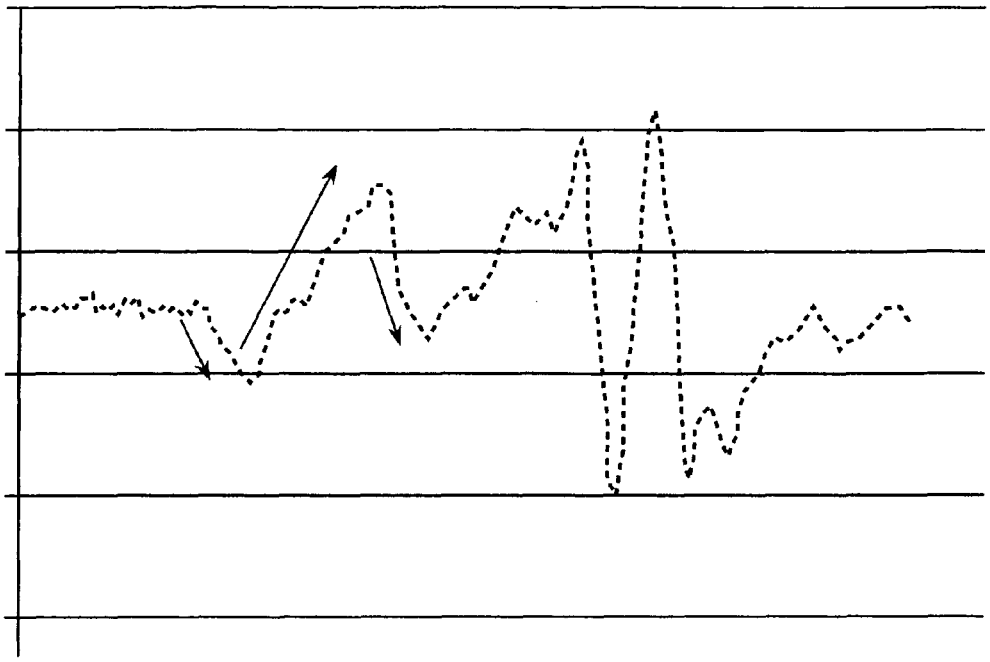
FIG. 9 shows a diagram obtained by measuring the movement of a golf swing by an acceleration sensor. When the obtained data is made into a graph, similar waveforms can be constantly depicted in the graph, with the graph showing the state where after shifting to a dynamic state, the value is decreased first, is increased next, is decreased again and, further is increased again.
Figure 10:
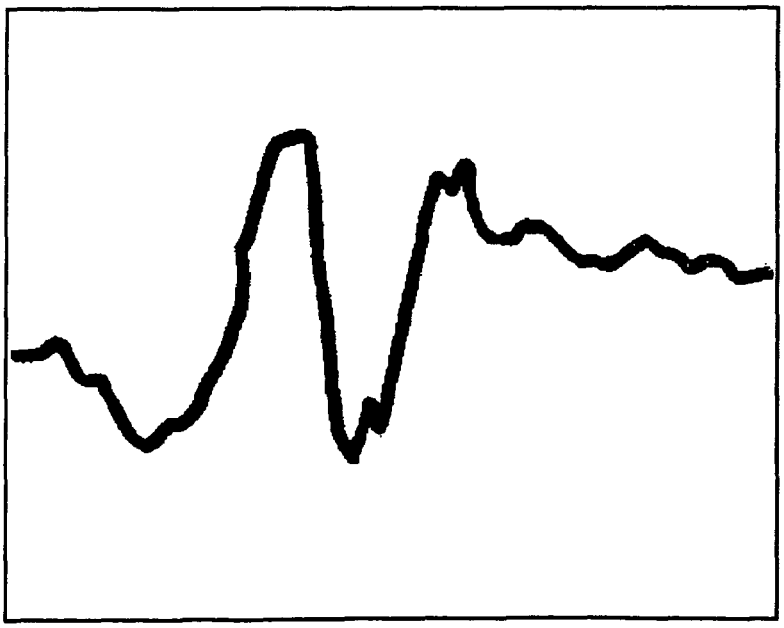
FIG. 10 is a Y-axis waveform chart of the golf swing.
Figure 11:
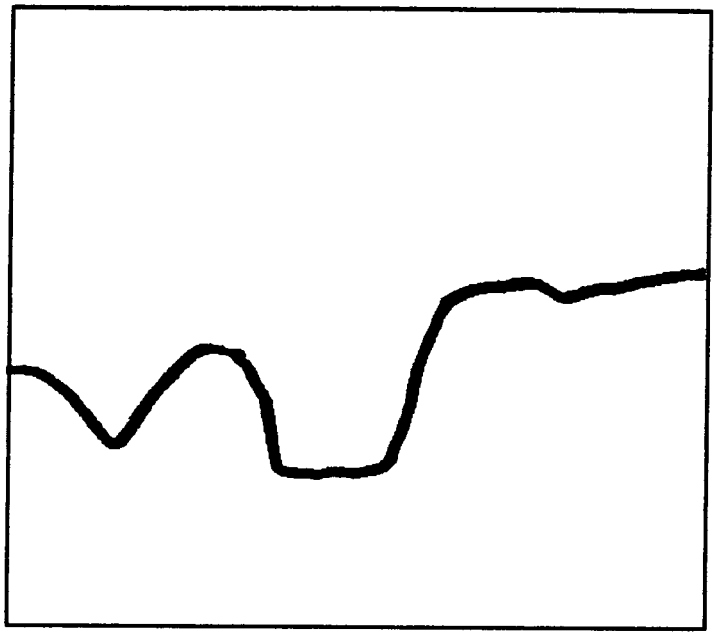
FIG. 11 is a X-axis waveform chart of the golf swing.
Figure 12:
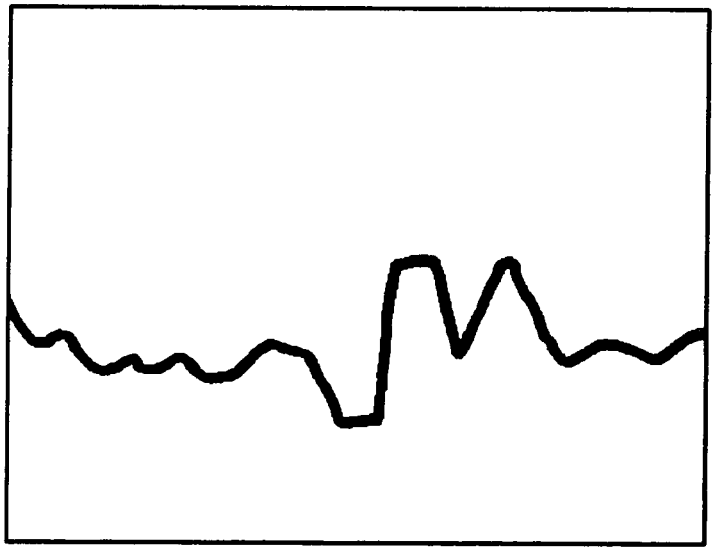
FIG. 12 is a Z-axis waveform chart of the golf swing.
Figure 13:
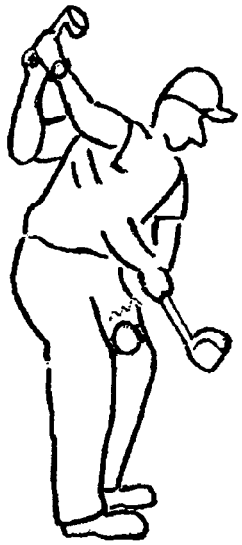
FIG. 13 illustrates a golf player wearing a vibration device on the lower limbs (thigh).
Figure 14:
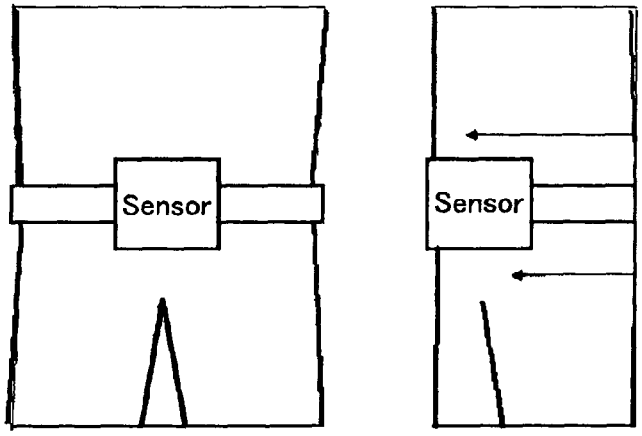
FIG. 14 illustrates a rotation of the waist with a waist band which incorporates the sensor to detect the shifting movement of the upper and lower limbs. This is showing that the sensor which detects the shifting movement is mounted at the X positions of the upper and lower limbs and the start of the lower limbs is instructed at the timing that the upper limbs go above the lower limbs and immediately before the upper limbs form the "top swing position".
Figure 14:
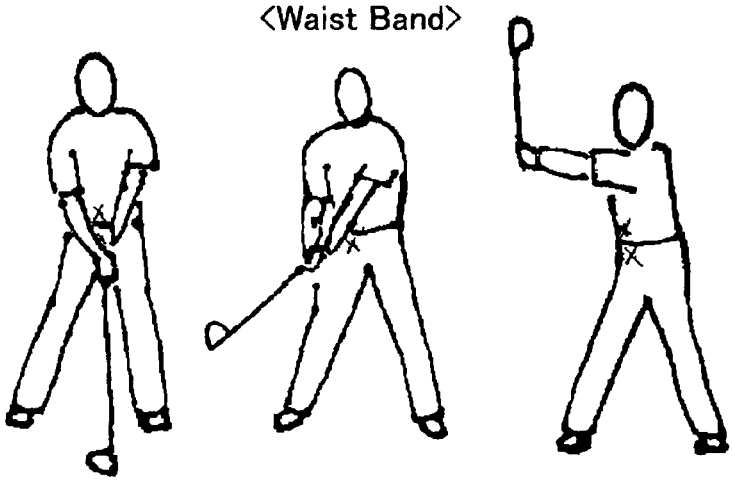
Figure 15:
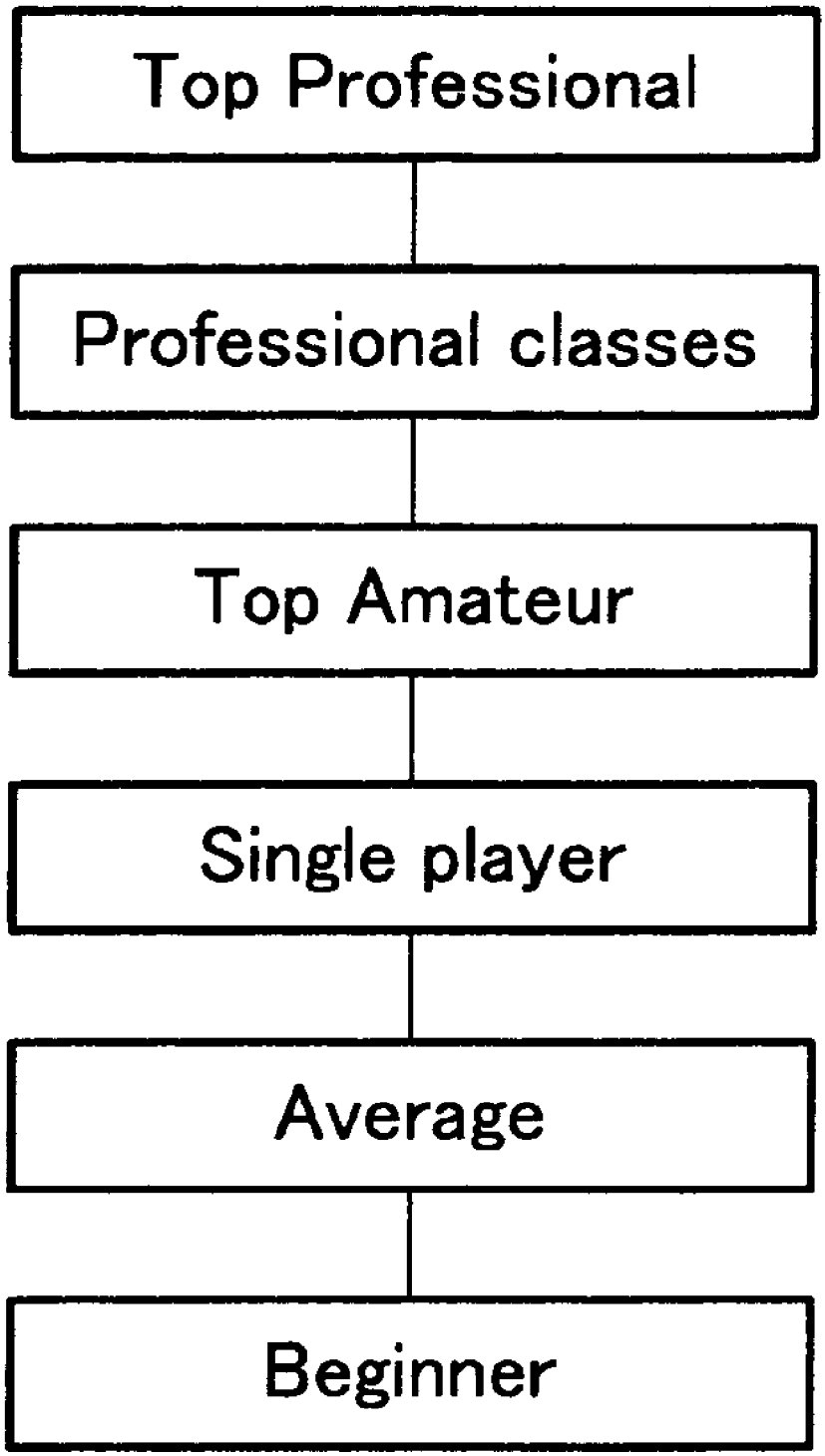
FIG. 15 is a flowchart separately provided for respective classes from top professional players to beginners.

All descriptions of the basics of a golf swing, golf being a ball hitting exercise, are based on the premise of right-handed hitting, however, it is possible to apply the basics of the golf swing to left-handed hitting by reversing left and right. The golf swing is started by grasping the grip of a golf club which is uniformly performed by uniting both hands with a feeling of harmony, and it is important that the gripping force is controlled with sensitive feeling about the weight of the club and the movement of the club head, since the hands are an important part which has a large significance as a function of the brain.

In the golf swing, it is necessary to consistently control the movement of the hands, and the main point in addressing the ball is to have a calm, comfortable, relaxed feeling, and with respect to the posture at that time, and it is important to form the posture with which the swing can be smoothly performed without continuous strain attributed to overstraining the muscles. The player has to perform the golf swing freely under self-control by maintaining a state that he/she is sensitive to external stimuli and keeping alert in such a manner that he/she can quickly move to any direction.

With respect to the position of the head, in addressing the ball, the player slightly turns the head to the right and puts his/her chin down and, when the player holds the head in this position. The club can be swung back with relaxed muscles of both shoulders and arms and all energy is used for hitting before the head returns to the front by rotating thus conducting an effective golf stroke. When the backswing is started, there are no conspicuous independent actions of both hands and wrists, however, when there is sufficient bending in the wind-up in which the club is brought back in the direction opposite to the target line, gripping by the left hand is slightly tightened and the golf club is moved toward the top while pushing up the golf club backward with the left side and the left arm is sufficiently conducted, tense feeling is generated in the left upper limbs, that is, the left side upper portion from the left waist to the left shoulder, the left arm and hand. When the posture of the top swing is formed, the weight of the club head and the inertia of the club head apply a slight pulling feeling to both hands thus prompting the full bending of both wrists. In the golf swing, energy is suitably taken out from the body by making use of reaction energy from the soles of both feet which support the body weight. The body weight at address is evenly divided into both feet and is concentrated on the inner side of the bulge at the root of the first toe of the left foot and the inner side of the right foot at the top of the swing. During the swing, the right knee is held as still as possible and the center of gravity shifted to the right side is received by the right hip joint. What assures high efficiency in golf is a proper use of the left arm. The more straight the left arm stretches, the larger the circular arc of the backswing becomes, and it is possible to make the same trajectory every time this is repeated. Hence, straightly-stretched left arm is a factor of good form which also contributes to the speed of the club head, accurate contact on the ball, and the consistency of the action. Although it is unavoidable to have a slightly bent arm when the left arm can not stretch straight, it is important, as far as the left arm is concerned, the left arm should not bend when hitting. When the left arm can fully stretch sufficiently at the top of the swing, it is supposed that the left arm can be straight when the downswing is started from the backswing.

In a golf swing, the important action is to start the downswing by uncoiling the lower limbs toward the left side. When the left waist does not lead the down stroke, no power is generated in the swing and the swing lacks accuracy as well as consistency. No matter how perfect the backswing is, when both hands, both arms or both shoulders lead in starting the downswing, the swing becomes a so-called "hand hit swing" and the club immediately loses the leading role of the movement of the whole body and the benefit of the power supposed to be supplied from the muscles of the waist and the back is also lost. When this happens, the club is left up in the air and results in the "hand hit swing" which is manipulated by both hands and arms and lacks stability and efficient combination with consistency.

Accordingly, since the down stroke, which is important in the downswing, is lead by the uncoiling of the trunk by starting the downswing with the return of both waists, the left side again becomes a focal issue. When the downswing is perfectly conducted by the potential power in the muscles of the legs and the back, there should be a pulling or stretching feeling in the upper limbs and the whole arm to the grip end of the golf club from the left side. When the full swing is correctly performed while both hands and the club are still advancing backward, the uncoiling of the trunk, lead by the lower limbs, is started from the left side, and this order of motions has an effect of achieving two important results. One of the results is that the basic factors, which lead the down stroke, are to start from the left foot and to return the waist to the left side. These factors generate power used in the form of the kinetic momentum of the club head by the reverse twisting of the body. The other result is an effect of completing the cocked wrist which is completed with the wrist forming a bent shape as the result of both waists withdrawn to one direction and the club head moved in the opposite direction.

While feeling that the club head is left at the top when the downswing is started, the return of both waists is very quick, and the return of both waists, which reverses the rotation toward the ball, is started before the club is swung backward and arrives at the end point in such a manner that the left leg starts to stretch straight and the left heel is returned to the ground before the downswing, while both hands are positioned at the height of the shoulders or the above the shoulders.

Accordingly, the present invention is directed to a start timing instruction device and a method using the device to specify the timing from the backswing to immediately before the top swing and to inform the timing of the downswing to the player so that, at the timing, the lower limbs lead the downswing while the upper limbs form the top of the swing thus realizing a powerful downswing by the returning from being twisted of the upper and lower limbs about the trunk.

The present invention informs the starting of the downswing at the appropriate time. According to the present invention, the instruction of desired start timing can be made based on the basic golf swing mechanism in which the downswing should start before the actual top swing position of the player is formed, whereby the difference in the returning from being twisted is made by twisting the trunk with the upper limbs forming the "top swing posture" and the lower limbs leading to start the downswing. This action causes the stretching and the contraction of muscles to generate power, and the start of the lower limbs is informed before sufficiently twisting the upper limbs, whereby the downswing can be performed at the effective time.

The followings are average values for several categories obtained by comparing the golf swings performed by professional players and amateur players.

Average Necessary Time from Start of Swing to Impact

Professional players: 1.07 seconds

Advanced amateur players: 1.28 seconds

Average players: 1.45 seconds

Average Necessary Time from Start of Swing to Start of Downswing

Professional players: 0.81 seconds

Advanced amateur players: 0.94 seconds

Average players: 1.03 seconds

Average Necessary Time from Start of Downswing to Impact

Professional players: 0.26 seconds

Advanced amateur players: 0.34 seconds

Average players: 0.42 seconds

Professional golfers execute the basic golf swing, and there is a certain agreeableness realized in the tempo of the backswing and the downswing performed by the professional golfers. Normally in a professional swing, the lower limbs start the downswing prior to the formation of the "top swing posture" by the golf club, and the time from start to finish of a golf swing takes approximately 1.5 seconds for professional players.

On the other hand, approximately 2 seconds for amateur players, and the time from the downswing to the impact takes less than 25% of the total time of the swing for professional players and in the vicinity of 30% for amateur players. Accordingly, amateur players whose swings are slow also generate a small impact force, and the difference between the impact force of amateur players and that of professional players is large. This is caused by a "hand hit swing" by amateur players who cannot make the effective impact.

Unlike amateur players, professional players, efficient in linking their arms and legs in motion to perform a power swing using the trunk, fully utilize the club with the time balance from start to impact being 75% for the backswing and 25% for the downswing to impact. According to the present invention, in order to learn such timing, this balance is adjusted to individual characteristics to perform the swing at the timing immediately before the top is formed from the start of the downswing, as the professional player starts the lower limbs at the timing that the body weight is shifted to the pivoting foot and the upper limbs going above the lower limbs to approach the top from the posture where the arms are positioned at parallel level half-way back, then the upper limbs form the top through inertia.

In an instruction device according to the present invention, such ideal timing is obtained by measuring the backswing using an angular velocity sensor or an acceleration sensor. It informs the start of the downswing to the player. In addition, the acceleration sensor picks up noise, and it is necessary to process this to differentiate the static state and the dynamic state, and it is important for the user to understand this problem. The instruction to the player is setup so that there can be either a physical or physiological stimulation. Through this means of instruction to inform the player about the predetermined timing in golf swings, the downswing is started with the body swing in which the shifting of the body weight to the left lower limb consisting of the left foot and left waist using the trunk as an axis, that is, the lower limbs start the downswing and the arms which constitute the upper limbs form the "top swing posture". Using the trunk through this twisting phenomenon in which power is generated by the upper and lower limbs pulling each other in the opposite directions, head speed is increased. In this manner, a golf swing can be realized at a favorable timing. This technique is very important to start the downswing with the lower limbs which naturally causes the delay of the club head. The power of the trunk, which is the center of the body having large power, is added sequentially with the speed, etc., and is transmitted thus increasing the energy and the speed of the fingers. The fingers are the terminating portions having small power.

With this technique, the downswing can be started maintaining energy in the head while feeling that the club head is left at top in starting the downswing and that the club shaft is used like a whip. In starting the downswing, when the lower limbs start while maintaining the cocked wrist which is formed at the top, the club shaft naturally goes down in the longitudinal direction, and both arms are dropped in front of the chest. In this manner, a logical golf swing following the force of the gravity can be performed. In order to efficiently use the rotational energy of the body including the golf club, by maintaining a small angle of cocked wrists, the swing is performed in a suppressing manner as much as possible until impact, thus executing a logical body swing following physical characteristics and physical laws, whereby a logical golf swing incorporating the basic technique can be executed.

According to the present invention, in view of the logical movement of the trunk in the hitting exercise, the use of the upper and lower limbs is introduced from the swing data at the professional level, whereby the movement is complemented and improved, and the swing is sped up.

According to the present invention, while the lower limbs start the downswing immediately before the top of the swing, the upper limbs approach the top through inertia. It eventually enhances the speed. The flow of the swing is maintained and an effective vector flow toward the downswing is made, whereby the golf swing effectively utilizes the energy generated by an adverse movement of the upper and lower limbs.

The action to hit the ball is notional. When the way of thinking that to hit a ball which is in a motionless state by consciously approaching the ball is not improved, technical differences occur. To cast aside the way of thinking of consciously approaching the ball, it is preferable to improve the way of thinking when the player is young. A lower limb starting device according to the present invention corrects and improves the "hand hit swing".

In the golf swing performed by shifting the center of gravity and by the rotational movement in a posture where the player stands upright on two feet with the back bone as a longitudinal axis, the adverse twisting of the upper limbs and lower limbs is a difficult technique. To help the player learn such technique, according to the present invention, the timing immediately before the upper limbs form the "top swing posture" is specified in such a manner that the movement of the upper limbs is detected when the backswing is started with the body weight equally distributed to both feet at the start and then, the weight distribution to both feet is shifted to the pivoting foot half-way back and the preparation for starting the lower limbs is finished. A stimulator of the instructing device is mounted on the vicinity where the lower limbs start or where they easily start. Such "instructing means" informs the timing of the downswing by vibration and/or vibration and sound and indicates how to use the lower limbs.

The instruction can be made so that the action from the start of the swing to the top takes 0.8 to 1 seconds and the action from the downswing to impact takes 0.3 to 0.5 seconds. Informing of the timing is conducted either by the golf club or by a technique which mounts a magnetic moving object on the golf club which is moved apart due to the magnetic reaction at the backswing and informs the timing of the downswing. When the downswing is started with the lower limbs, the club head moves in the opposite direction and the wrist takes a bending shape at the top position. While maintaining the cocked wrists of both arms at the start of the downswing and the golf club feeling that the club head is left at the top, both arms and the golf club are dropped in front of the body and swung with the grip end nearing the trunk. The swing is performed as fast as possible aiming for the time from downswing to impact to be 0.4 seconds or less. The golf swing uses twisting of the trunk by effectively making use of the upper and lower limbs.

It is said that there are a great variety of golf swings of professional players as well as amateur players, however, when data are analyzed, professional players perform the swing at similar timing while amateur players perform the swing at incoherent timings in comparison with professional players. The difference between professional players and amateur players is obvious.

In view of the difference between professional players and amateur players, the present invention is made for a player to learn the basic downswing and to correct his/her mistakes. The player is informed of the timing for when to start the lower limbs after the back swing is started, the upper limbs form the "top swing posture". This timing to start the lower limbs is specified adjusting to individual players, and using sensor which detects the movement of the upper limbs. In this manner, the start of the lower limbs immediately before the top swing and/or at the top swing is instructed. The swing movement is instructed in association with physical law.

In order to correct a "hand hit swing", which is said to be a bad habit of amateur players, and make it closer to the basic swing as desired, the actual swing of the player is checked to confirm differences from the basic swing. The timing that the downswing is started in the swing starting from the backswing is estimated. For this purpose, the swing is measured by an angular velocity sensor and/or an acceleration sensor to detect the timing of the start of the lower limbs. Then, the timing is informed to the player. This is made with respect to the movement of the upper and lower limbs in the downswing, the upper limbs become parallel to the ground half-way back, the lower limbs stop while receiving the shift of the body weight at the inner side of the right foot heel and, thereafter, the upper limbs approach the "top swing posture" through inertia. According to the present invention, the player is instructed so that the lower limbs start at such timing. In this manner, the downswing is performed at the timing of the start of the lower limbs which is instructed by a sensor system, resulting in the ability to make the logical swing at the professional level. In this manner, the instruction of the basic exercise can be performed by the timings of the instructing device which can be individually set for each player.

The down swing instructing device is an exercise instructing device which improves the functional effect of the hitting exercise in the golf swing.

Embodiments of the present invention can further be described as follows. According to one embodiment of the present invention, a start timing instructing device informs a player of the start timing of the lower limbs and allows the player to do hitting exercises at the effective timing in a golf swing. The golf swing is a body movement of a ball-hitting exercise in which a backswing is performed by moving a golf club in the direction opposite to the direction a ball is hit. The body which includes the upper and lower limbs is twisted, the upper limbs form a top swing posture, and the lower limbs take a role leading the body movement in starting the downswing as returning from being twisted. The returning movement from the twisted body generates hitting power stretching and contraction muscles. The lower limbs are started back before the upper limbs are sufficiently twisted, immediately before the top swing position.

To measure the golf swing, a wristwatch-type device may be mounted on the left wrist or the left arm or, alternatively, on the right wrist or the right arm, which may have an angular velocity sensor. By using the sensor, the golf swing is measured. The angular velocity of the data is analyzed by a computer or microprocessor. The analyzed data is stored in the microprocessor which performs the following steps or controls based on the computer program lists or source codes (A), (B), and/or (C) described below. Executing the program lists, the player is instructed on when he or she should start the downswing. This can be done by the instruction set and adjusted by the microcomputer functionally connected to a variable resistor. The start timing instructing device may include a downswing instructing means and a controller body of the downswing instructing means. The detected angular data is inputted into the microprocessor of the control device. The data is processed by the microprocessor. The timing to start the lower limbs may be set by the microcomputer and manually adjusted by a volume of the variable resistor. The data after performing the signal processing is utilized depending on a purpose. The microprocessor generates the instruction using the program lists, and an instruction transmission device sends the instruction to the player.

In the method, the timing of the start of the lower limbs may be detected and controlled in such a manner that the action of the golf swing is measured using the angular velocity sensor. A voltage of detected angular velocity is integrated by time to obtain an angle to read the angle immediately before the top position. When the player is right-handed, by aligning a face surface of the club head, the back of the left hand and the left arm in a straight and fixed manner and by performing a backswing straightly. As a stimulator, the downswing instructing means may use a perception electric current generation device provided with a wireless reception function which applies an electric current to a part of the player to stimulate the body part. The instruction transmission device may have a wireless transmission function which transmits an action instruction to the perception electric current generation device. As such, the computer and instruction transmission device allows for the detection of the timing immediately before the top swing from the backswing position which is predetermined for each player in the manner that an angular velocity is measured by the angular velocity sensor. The angular velocity is integrated to obtain an angle.

If a point of agreement is confirmed between the detected angle and the set or adjusted angle by the variable resistor, the instruction transmission device sets and sends the timing instruction (start timing instruction). The instruction transmission device informs the player of the timing by timely operating a vibration device or a sound device mounted on a part of the body and/or a part of the lower limbs. The parts are preferably where the lower limbs easily start by applying the stimulation.

After the swing data measured by the acceleration sensor, the data is input to the downswing instructing means and the control device so that it is processed by the computer. A/D conversion of analogue data outputted from the acceleration sensor is performed, the signal processing of digital data is performed, and the data after signal processing is utilized depending on the purpose. The position immediately before the top swing is confirmed, and the change amount of the acceleration sensor is indicated, followed by a half-way back swing which sets a stop flag of the lower limbs occurs from stopping of the waist in the backswing. The upper limbs further move upward through inertia and form the top swing posture. It is understood that a stop flag of a golf club is set on performing the downswing by turning from the top swing. The flow of these changes occurs commonly in the same manner.

When it is assumed that the action of the golf swing always changes in this manner, this is also true with respect to the waveform obtained by the acceleration sensor during the action of the golf swing, i.e., after shifting to a dynamic state, a value decreases first, increases next, decreases again, and increases again. Such a waveform may be preliminarily stored in the computer. The stored waveform and a waveform obtained by the acceleration sensor at actual hitting may be compared. The timing of start of the lower limbs prior to a stop state of the top swing may be introduced as an amount of the change in the acceleration sensor, and this is given to the downswing instructing means. The stop flag is searched and found by the computer. The stop flag is set, and the backswing is started. The start timing instructing device prompts the player to start the lower limbs in such a manner that at some timing from the half-way back swing to the top swing after the back swing, the controller receives the measurement result of the acceleration sensor. The instruction timing may be adjusted using the variable resistor in the control part. This may adjust and set the timing of start of the lower limbs for each player separately using the microcomputer and the variable resistor in the control part.

The controller informs the player of the timing by applying stimulation using vibration or sound or electric stimulation by a vibration device or sound or electric device mounted on a part of a body or a part of the lower limbs. This is where the body may easily be stimulated to start.

The acceleration data may contain a noise so that it is difficult to distinguish a static state and a dynamic state. Accordingly, a group of data which is input into the microcomputer from the acceleration sensor followed by the A/D conversion can be processed separately, by obtaining an average value of data measured at three successive points. Rough data attributed to the noise is smoothed and converted into data suitable to be processed separately.

For example, it is assumed that there are successive values A, B, C. The differences between values are AB=B−A, BC=C−B, and CD=D−C. The three differences between the successive values are compared at one time to divide the state into the static state and the dynamic state. A first condition is that all three values of differences have the same symbol, and a second condition is that the absolute values of the total of these differences are a certain value or more. When the first condition and the second condition are not satisfied simultaneously, the data is considered as noise and as being in the static state. After it is determined that the state is the dynamic state, it is further necessary to determine whether the state is the top swing. For example, even if in the dynamic state when the change amount is small, the state is not taken as a rotational movement of the body, but taken as rough standard of the change amount. The change amounts of the three successive points are calculated, and the absolute value of the change amounts and the predetermined value are compared to determine whether the state is of the backswing action. After the noise is processed, the data is set in the microcomputer which uses the program lists described below to instruct the start timing of the lower limbs. The instruction of the downswing is transmitted to a stimulator mounted on the body.

According to another embodiment, a start timing instructing device includes the downswing instructing means which includes a mounting structure for mounting on a player's body and is able to apply stimulation physically or physiologically to the player's body by controlling with a microcomputer and a variable resistor.

According to another embodiment, a start timing instructing device includes the mounting structure which is controlled by the microcomputer. The downswing instructing means can be mounted on the thigh and/or the head on the vicinity of the cerebral cortex. The downswing instructing device can stimulate the waist and/or the head.

According to another embodiment, a start timing instructing device includes the sensor which measures the timing of the downswing. This may be an angular velocity sensor or a six-axis exercise sensor which is an acceleration and angular velocity sensor.

According to another embodiment, a start timing instructing device is controlled by the microcomputer which is communicably connected with the downswing instructing means via a communication line. A stimulator or vibrator may include a mobile phone. An image display device is constituted of a mobile phone which is connectable to the communication line.

According to another embodiment, the body of a start timing instructing device is supervised by a computer, which includes a sensor for measuring, a microcomputer for control and a variable resistor, which is connected to the downswing instructing device and has respective parts thereof connected with a wireless line and instructs exercise.

According to another embodiment, a start timing instructing device includes the downswing instructing means which includes a mounting structure for mounting on a player's body and is able to apply stimulation physically or physiologically to the player's body by controlling with a microcomputer and a variable resistor.

According to another embodiment, a start timing instructing device includes the mounting structure which is controlled by the microcomputer. The downswing instructing means can be mounted on the thigh and/or the head on the vicinity of the cerebral cortex. The downswing instructing device can stimulate the waist and/or the head.

According to another embodiment, a start timing instructing device includes the sensor which measures the timing of the downswing, which is an acceleration velocity sensor or a six-axis exercise sensor which is an acceleration and angular velocity sensor.

According to another embodiment, a start timing instructing device is controlled by the microcomputer, which is communicably connected with the downswing instructing means via a communication line, which may be a mobile phone. An image display device is constituted of a mobile phone which is connectable to the communication line.

According to another embodiment, the body of a start timing instructing device is supervised by a computer, which includes a sensor for measuring, a microcomputer for control and a variable resistor, which is connected to the downswing instructing device and has respective parts thereof connected with a wireless line and instructs exercise.

According to another embodiment, a start timing instructing device includes the downswing instructing means which includes a mounting structure for mounting on a player's body and is able to apply stimulation physically or physiologically to the player's body by controlling with a microcomputer and a variable resistor.

According to another embodiment, a start timing instructing device includes the mounting structure which is controlled by the microcomputer. The downswing instructing means can be mounted on the thigh and/or the head on the vicinity of the cerebral cortex, and the downswing instructing device can stimulate the waist and/or the head.

According to another embodiment, a start timing instructing device includes the sensor which measures the timing of the downswing, which is an angular velocity sensor, an acceleration sensor or a six-axis exercise sensor which is an acceleration and angular velocity sensor.

According to another embodiment, a start timing instructing device is controlled by the microcomputer, which is communicably connected with the downswing instructing means via a communication line, which may be a mobile phone. An image display device is constituted of a mobile phone which is connectable to the communication line.

According to another embodiment, the body of a start timing instructing device is supervised by a computer, which includes a sensor for measuring, a microcomputer for control and a variable resistor, which is connected to the downswing instructing device, has respective parts thereof connected with a wireless line and instructs exercise.

Although only some exemplary embodiments of this invention have been described in detail above, those skilled in the art will readily appreciated that many modifications are possible in the exemplary embodiments without materially departing from the novel teachings and advantages of this invention. Accordingly, all such modifications are intended to be included within the scope of this invention.

The disclosure of Japanese Patent Application No. 2009-26821 filed Feb. 7, 2009 including specification, drawings and claims is incorporated herein by reference in its entire.

(A) Computer Program List for a Control Using an Angular Velocity Sensor

The computer program listing filed as a text file via EFS-Web on May 2, 2011 and on Jul. 13, 2011 is incorporated herein by reference.

Angular Velocity Sensor of lower limbs attached file.

```
        LIST        P=12F683
        INCLUDE     "P12F683.inc"
        __CONFIG _INTRC_OSC_NOCLKOUT & _WDT_OFF & _PWRTE_OFF &
_MCLRE_OFF & _CP_OFF & _CPD_OFF & _BOD_OFF & _IESO_OFF &
_FCMEN_OFF
;
;                   definition of the fixed number
;
W       EQU         0       ;
F       EQU         1       ;
C       EQU         0       ;
bit0    EQU         0       ;
bit1    EQU         1       ;
bit2    EQU         2       ;
bit3    EQU         3       ;
bit4    EQU         4       ;
bit5    EQU         5       ;
bit6    EQU         6       ;
bit7    EQU         7       ;
;
;---------- PIC established register definition ----------
;INDF   EQU         H'00'   ;
;FSR    EQU         H'04'   ;
;;OPTION_REG        EQU     H'01'           ;Option_Register
;PCL    EQU         H'02'   ;
;STATUS             EQU     H'03'           ;
;GPIO   EQU         H'05'   ;
```

-continued

```
;;TRISIO         EQU     H'05'       ;
;PCLATH          EQU     H'0A'       ;
;INTCON          EQU     H'0B'       ;
;PIR1    EQU     H'0C'   ;
;TMR1L           EQU     H'0E'       ;
;TMR1H           EQU     H'0F'       ;
;T1CON           EQU     H'10'       ;
;;PIE1   EQU     H'0C'   ;
;;PCON   EQU     H'0B'   ;
;;OSCCON         EQU     H'0F'       ;
;;OSCTUNE        EQU     H'10'       ;
;;ADRESL         EQU     H'1E'       ;
;ADRESH          EQU     H'1E'       ;
;ADCON0          EQU     H'1F'       ;
;;ANSEL          EQU     H'1F'       ;
;
;---------- general-purpose register definition ----------
saveW   EQU     H'20'   ;
saveS   EQU     H'21'   ;
BZ_onT  EQU     H'22'   ;
Timer1  EQU     H'23'   ;
Timer2  EQU     H'24'   ;
RegA    EQU     H'25'   ;
RegB    EQU     H'26'   ;
RegC    EQU     H'27'   ;
RegD    EQU     H'28'   ;
REF     EQU     H'29'   ;
DL      EQU     H'2A'   ;
DH      EQU     H'2B'   ;
AL      EQU     H'2C'   ;
OutBuf  EQU     H'2D'   ;
FLAG    EQU     H'2E'   ;
                        ; bit0---
                        ; bit1---
                        ; bit2---
                        ; bit3---
                        ; bit4---
                        ; bit5---
                        ; bit6---
                        ; bit7---
;
;               I/O
;
;Vss ---- power supply, input and output COM Pin8
;bit 0--- program Data          Pin7(Input)
;bit 1--- program Clock         Pin6(Input)
;bit 2--- Angle setting input   Pin5(Input)
;bit 3--- program Vpp           Pin4(Input)
;bit 4--- angular velocity sensor Pin3(Input)
;bit 5--- buzzer                Pin2(output)
;Vdd ---- power supply          Pin1
;
;                       start addressing of the program
        ORG     h'0000' ;PIC
        GOTO    INITIAL                 ;
;
;                       work to interrupt it ( 8 mSec)
        ORG     h'0004' ;
;---------- save of the register -----------
        MOVWF           saveW           ;save W into saveW
        SWAPF STATUS,W                  ;
        MOVWF           saveS           ;save STATUS into saveS
;---------- AD Channel discrimination -----------
        BTFSC   OutBuf,bit5             ;
        GOTO    Tdec                    ; on Tdec
;====== angular velocity value uptake addition save ======
        MOVF    ADRESH,W                ;
        MOVWF           AL              ;
        SKPNZ                           ;
        GOTO    INT0                    ;
        MOVLW           d'5'            ;
        SUBWFAL,W                       ;AL-5
        SKPNC                           ;AL<5
        GOTO    INT1                    ;
;---------- angular velocity value <=10 ----------
INT0
        CLRF    DL                      ;
        CLRF    DH                      ;
        CLRF    FLAG                    ;
;*****
;
```

-continued

```
        MOVLW           b'00001001'     ;
        MOVWF           ADCON0          ;set point uptake start
        CALL    u_WAIT                  ;
        BSF             ADCON0,GO       ;AD START
        BTFSC   ADCON0,NOT_DONE
        GOTO    $-1
        MOVF    ADRESH,W                ;
        MOVWF           REF             ;
        MOVLW           b'00001101'     ;
        CALL    u_WAIT                  ;
        BSF             ADCON0,GO       ;AD START
;       MOVLW           b'00001111'     ;
;       MOVWF           ADCON0          ;
;*****
        GOTO    Iret                    ;
;---------- angular velocity value > 10 ----------
INT 1
        BTFSC   FLAG,bit0               ;
        GOTO    INT2                    ;
        MOVF    AL,W                    ;
        ADDWF           DL,F            ;
        SKPNC                           ;
        INCF    DH                      ;
        ADDWF           DL,F            ;
        SKPNC                           ;
        INCF    DH                      ;
        ADDWF           DL,F            ;
        SKPNC                           ;
        INCF    DH                      ;
        ADDWF           DL,F            ;
        SKPNC                           ;
        INCF    DH                      ; 4 times
        MOVF    DH,W
        SUBWF   REF, W                  ;REF - DH
        SKPC                            ;
        GOTO    INT3                    ;REF < DH
INT2    MOVLW           b'00001111'     ;
        MOVWF           ADCON0          ;
        GOTO    Iret                    ;
;---- It turns to a setting angle -----
INT3
        BSF     OutBuf,bit5             ;
        MOVF    OutBuf,W
        MOVWF           GPIO            ; buzzer on
        MOVLW           d'20'           ;
        MOVWF           Timer1          ; buzzer on
        CLRF    DL                      ;
        CLRF    DH                      ;
        BSF     FLAG,bit0               ;
        GOTO    Iret                    ;
;---------- Timer ----------
Tdec
        MOVF    Timer1,F                ;
        SKPZ                            ;
        DECF    Timer1,F                ;
;---------- Return processing ----------
Iret
        BCF     INTCON,bit2             ;TMR0
        SWAPF   saveS,W                 ;
        MOVWF           STATUS          ;return STATUS from saveS
        SWAPF   saveW,F                 ;
        SWAPF   saveW,W                 ;return W from saveW
;       RETFIE
;               Initial setting
        ORG     H'080'          ;
INITIAL
        MOVLW           b'00000000'     ;GPIO prohibit the unsettled output
        MOVWF           GPIO            ; write in it before
        BSF STATUS,bit5         ; Register bank 1
        MOVLW           b'11011111'     ;
        MOVWF           TRISIO          ;GPS output, input mode
        MOVLW           b'1000100'
        MOVWF           OPTION_REG      ;PULL UP Unavailable, TMR0 1/32
        MOVLW           b'01100001'     ;
        MOVWF           OSCCON          ;4 MHz
        MOVLW           b'00001100'     ;
        MOVWF           ANSEL           ;AD Fosc/2, AN2,AN3 Analog_Port
        BCF     STATUS,bit5             ; register bank 0
        MOVLW           b'00001001'     ; set it to a port
        MOVWF           ADCON0          ;Left justified, Ref_Vdd, AN2,
```

-continued

```
conversion start
        CLRF    FLAG                    ;
        CLRF    OutBuf                  ;
;---------- Initial set point uptake ----------
        CALL    M_WAIT                  ;
;       MOVLW           b'00001011'     ;
;       MOVWF           ADCON0          ;
;       CALL    M_WAIT                  ;
;       MOVF    ADRESH,W                ;
        MOVLW           0FFH            ;W register MAX set
        MOVWF           REF             ;
;---------- angular velocity uptake start ----------
        MOVLW           b'00001101'     ;
        MOVWF           ADCON0          ; reshuffling
        CALL    M_WAIT                  ;
        MOVLW           b'00001111'     ;
        MOVWF           ADCON0          ; uptake start
;---------- TMRO Interrupt permission ----------
        MOVLW           b'10100000'     ;
        MOVWF           INTCON          ; TMR0 Interrupt permission
;
;                       Main routine
MAIN
        BTFSS   GPIO,bit5
        GOTO    MAIN
        MOVF    Timer1,F                ;
        SKPZ                            ;
        GOTO    $-2                     ;
        BCF     OutBuf,bit5             ;
        MOVF    OutBuf,W                ;
        MOVWF           GPIO            ; off
        GOTO    MAIN                    ;
;
;                       Idling
M_WAIT
        MOVLW           d'250'          ;
        MOVWF           RegB            ;
        MOVLW           d'249'          ;
        MOVWF           RegA            ;
        NOP                             ;
        DECFSZ          RegA,F          ;
        GOTO    $-2                     ;
        DECFSZ          RegB,F          ;T = (RegB)X1 mSec
        GOTO    $-6                     ;
        RETURN                          ;
u_WAIT          ;AD
        GOTO    $+1
        GOTO    $+1
        GOTO    $+1
        GOTO    $+1
        GOTO    $+1
        GOTO    $+1
        GOTO    $+1
        GOTO    $+1
        GOTO    $+1
        GOTO    $+1
        RETURN
        END
```

(B) Computer Program List for a Control Using an Acceleration Sensor

Acceleration Sensor of lower limbs attached file.

```
        LIST                            P=12F683
        INCLUDE                         "P12F683.inc"
        __CONFIG_INTRC_OSC_NOCLKOUT & _WDT_OFF & _PWRTE_OFF &
_MCLRE_OFF &_CP_OFF &_CPD_OFF & _BOD_OFF & _IESO_OFF &
_FCMEN_OFF
;               definition of the fixed number
W       EQU     0               ; working register
F       EQU     1               ; origin of transfer
C       EQU     0               ; carry flag
bit0    EQU     0               ;
bitl    EQU     1               ;
bit2    EQU     2               ;
```

-continued

```
bit3        EQU   3                    ;
bit4        EQU   4                    ;
bit5        EQU   5                    ;
bit6        EQU   6                    ;
bit7        EQU   7                    ;
;--- PIC definition of the established register---
;INDF       EQU   H'00'                ; Indirect addressing
;FSR        EQU   H'04'                ; address pointer
;;OPTION_REG EQU                       H'01' ;Option_Register
;PCL        EQU   H'02'                ;low-ranking
;STATUS           EQU                 H'03' ; status register
;GPIO       EQU   H'05'                ; I/O port
;;TRISIO           EQU                 H'05'; designated register
;PCLATH            EQU                 H'0A' ; high-ranking parttimer
;INTCON            EQU                 H'0B' ;Interrupt control flag group register
;PIR1       EQU   H'0C'                ; Interrupt control flag group register
;TMR1L             EQU                 H'0E' ;
;TMR1H             EQU                 H'OF' ;
;T ICON            EQU                 H'10' ;
;;PIE1      EQU   H'OC'                ;
;;PCON      EQU   H'OB'                ;
;;OSCCON           EQU                 H'OF' ;setting register oinside oscillation
;;OSCTUNE          EQU                 H'10' ; adjustment register
;;ADRESL            EQU                H'1E' ;AD Conversion input data L
;ADRESH            EQU                 H'1E' ;AD Conversion input data H
;ADCON0            EQU                 H'1F' ;AD conversion control register
;;ANSEL            EQU                 H'1F' ; adjustment register
;
;------ definition of general-purpose register ----------
cblock H'20'
saveW       ;
saveS       ;
BZ_onT      ;
Timer1      ;
Timer2      ;
RegA        ; general-purpose register A
RegB        ; general-purpose register B
RegC        ; general-purpose register C
RegD        ; general-purpose register D
RegE        ; general-purpose register E
REF                         ; acceleration set point
DL                          ; Acceleration value L
DH                          ; Acceleration value H
AL                          ;SNS
AH                          ;SNS
AL_n 1      ; last time SNS
OutBuf      ; buffer for output
FLAG        ; flag register
                            ; bit0--- flag impossible of a re-start
                            ; bitl---
                            ; bit2---
                            ; bit3---
                            ; bit4---
                            ; bit5---
                            ; bit6---
                            ; bit7---
endc
;                 I/O layout of the port
;
;Vss    ----COM Pin8(power supply)
;
;bit 0---Data   Pin7(Input)
;bit 1---Clock  Pin6(Input)
;bit 2---       Pin5(Input)
;bit 3---Vpp    Pin4(Input)
;bit 4---       Pin3 (Input)
;bit 5---       Pin2(output)
;Vdd ----       Pin1(power supply)
;               start addressing of the program
                ORG h'0000';                    ;PIC
                GOTO INITIAL                        ;
;
;               work to interrupt it (8 mSec)
;
                ORG h'0004'                         ;
;----------save of the register----------------
                MOVWF                           saveW           ;save W into saveW
                SWAPF STATUS,W                  ;
                MOVWF                           saveS           ;save STATUS into saveS
```

-continued

```
----------AD Channel discrimination----------------
            BTFSC OutBuf,bit5                   ;
            GOTO Tdec                           ;
            BTFSC FLAG,bit1                     ;
            GOTO Tdec                           ;
;====== acceleration value uptake addition save ==========
            MOVF ADRESH,W                       ;sns
            movwf RegE                          ; keep it at one time
            ADDWF                               AL__n1,F        ;SNS+ This time
            BCF                                 STATUS,C        ;C Flg CLR
            RRF                                 AL__n1,F        ;1/2
            MOVF AL_nl,W                                        ;
            MOVWF                               AL              ;
            SKPNZ                                               ;
            GOTO INT0                                           ;
            MOVLW                               d'20'           ;
            SUBWFAL,W                                           ;AL-20
            SKPNC                                               ;AL<20
            GOTO INT1                                           ;
;----- Acceleration value <=20 --------
INT0
            BTFSC       FLAG,bit2       ; During multiplication
            GOTO        INT1            ; multiplication continuation
            CLRF        DL              ; Acceleration L
            CLRF        DH              ; Acceleration H
            CLRF        FLAG            ; Acceleration 0 start again
;*****
;           MOVLW                               b'00001101'     ;VR
;           MOVWF                               ADCON0          ; set point uptake start
;           CALL u_WAIT                         ; Waiting
;           BSF                                 ADCON0,GO       ;AD START
;           BTFSC ADCON0,NOT_DONE
;           GOTO $-1
;           MOVF ADRESH,W                       ; Acceleration setting input
;           MOVWF                       REF                     ; save a set point
            MOVLW                       b'00001001'             ;SNS
            CALL u_WAIT                 ;
            BSF                         ADCON0,GO               ;AD START
;           MOVLW                       b'00001011'             ;
;           MOVWF                       ADCON0                          ; acceleration uptake start
;*****
            GOTO Iret                   ;
;------ Acceleration value >10 -------
INT1
            BTFSC FLAG,bit0             ;
            GOTO INT2                   ;
;           MOVF AL,W                   ;
; Revision
            RRF                 AL,F            ;/2
            MOVLW               25                  ;0.3 V
            ADDWF               AL,F
;
            CLRF AH
            BCF                 STATUS,C        ;C Flg CLR
            RLF                 AL,F
            RLF                 AH,F
            RLF                 AL,F
            RLF                 AH,F
            RLF                 AL,F
            RLF                 AH,F
;           RLF                 AL,F
;           RLF                 AH,F
;           BCF                 STATUS,C                    ;C Flg CLR
;           RLF                 AL,F
;           RLF                 AH,F
            movf                AL,W
            addwf               DL,F
            btfsc               STATUS,C        ;3h,0
            incf                DH,F                        ;
            movf                AH,W
            addwf               DH,F
;           ADDWF               DL,F                        ;
;           SKPNC                               ;
;           INCF                DH              ;
;           ADDWF               DL,F                        ;
;           SKPNC                               ;
;           INCF                DH              ;
;           ADDWF               DL,F                        ;
;           SKPNC                               ;
;           INCF                DH              ;
```

-continued

```
;
;               ADDWF                   DL,F                            ;
;               SKPNC                                   ;
;               INCF                    DH                      ; 4 times
;
                MOVF DH,W
                SUBWFREF,W                              ;REF - DH
                SKPC
                GOTO INT3                               ;REF < DH
                NOP
                NOP
                MOVLW                   d'8'                    ;
                SUBWF DH,W              ;DH-8
                SKPNC                           ;DH<8
                GOTO INT2               ;
                BSF                     FLAG,bit2               ; During multiplication
INT2            MOVLW                   b'00001011'             ;SNS
                MOVWF                   ADCON0                  ; acceleration uptake start
                GOTO Iret                       ;
;---- It turns to setting acceleration -----
INT3
                BSF                     OutBuf,bit5     ;
                MOVF                    OutBuf,W        ;
                MOVWF                           GPIO            ; on
                MOVLW                           d'20'           ;
                MOVWF                           Timer1          ; on
                CLRF                    DL              ; Acceleration L
                CLRF                    DH              ; Acceleration H
                BSF                     FLAG,bit0       ;
                BCF                     FLAG,bit 1      ;
                BSF                     FLAG,bit2       ;
                GOTO                    Iret            ;
---------- Timer Subtraction ----------
Tdec
                MOVF    Timer1,F        ;
                SKPZ                    ;
                DECF    Timerl,F        ;
;---------- Return processing ----------
Iret
                BCF     INTCON,bit2             ;TMR0
                SWAPF saveS,W                           ;
                MOVWF                   STATUS                  ;return STATUS from saveS
                SWAPF saveW,F                   ;
                SWAPF saveW,W                           ;return W from saveW
;               RETFIE
;                                       Initial setting
                ORG     H'080'          ;
INITIAL
                MOVLW                   b'00000000'             ;GPIO prohibit the unsettled output
                MOVWF                   GPIO                    ; write it before setting
                BSF     STATUS,bit5             ; Register bank 1
                MOVLW                   b'11011111'             ;
                MOVWF                   TRISIO                  ;GP5 output, input mode
                MOVLW                   b'1000100'              ;
                MOVWF                   OPTION_REG              ;PULL_UP Unavailable, TMR0 1/32
                MOVLW                   b'01100001';            ;
                MOVWF                   OSCCON                          ;4 MHz
                MOVLW                   b'00001100';            ;
                MOVWF                   ANSEL                   ;AD Fosc/2,     AN2,AN3 Analog_Port
                BCF     STATUS,bit5             ; correct a register bank to 0
                MOVLW                   b'00001101'     ;
                MOVWF                   ADCON0                  ;Left justified, Ref _Vdd, AN2,
conversion start
                CLRF FLAG               ;
                CLRF OutBuf             ;
;--------- Initial set point uptake ----------
                CALL M_WAIT                             ;
                MOVLW                   b'00001111'     ;
                MOVWF                   ADCON0                  ; set point uptake start
                CALL M_WAIT                             ;
                MOVF ADRESH,W           ;
;               MOVLW                   0FFH                    ;W MAX
                MOVWF                   REF                     ; save a set point
;--------- acceleration uptake start ----------
                MOVLW                   b'00001001'     ;
                MOVWF                   ADCON0                  ; Reshuffling
                CALL M_WAIT
                MOVLW                   b'00001011'     ;
                MOVWF                   ADCON0                  ; start
```

-continued

```
;-------- TMR0 Interrupt permission ------------
        MOVLW           b'10100000'     ;
        MOVWF           INTCON          ;TMR0
;                       Main routine
MAIN
        BTFSS   GPIO,bit5       ;
        GOTO    MAIN            ;
        MOVF    Timerl,F        ;
        SKPZ                    ;
        GOTO    $-2             ;
        BCF     OutBuf,bit5     ;
        MOVF    OutBuf,W        ;
        MOVWF           GPIO            ; off
        MOVLW           d'250'          ;
        MOVWF           Timer1          ;
        MOVF Timer1,F           ;
        SKPZ                    ;
        GOTO    $-2             ;
        BCF     FLAG,bit1       ; re-start is possible
        GOTO MAIN               ;
;
;                       Idling
M_WAIT
        MOVLW   d'250'          ;
        MOVWF   RegB            ;
        MOVLW   d'249'          ;
        MOVWF   RegA            ;
        NOP             ;
        DECFSZ  RegA,F          ;
        GOTO    $-2     ;
        DECFSZ  RegB,F          ;T =(RegB)X1 mSec
        GOTO    $-6     ;
        RETURN                  ;
u_WAIT          ;AD u s
        GOTO    $+1
        GOTO    $+1
        GOTO    $+1
        GOTO    $+1
        GOTO    $+1
        GOTO    $+1
        GOTO    $+1
        GOTO    $+1
        GOTO    $+1
        GOTO    $+1
        GOTO    $+1
        GOTO    $+1
        GOTO    $+1
        RETURN
        END
```

(C) Computer Program List for a Control Using an Acceleration Sensor

Acceleration Sensor of lower limbs Attached file

```
// Header file include
#include <12f683.h>
#DEVICE ADC=10
// Configuration setting
#fuses  INTRC_IO, NOWDT, PUT, NOPROTECT, NOMCLR
#use delay(CLOCK = 8000000)
#use RS232(BAUD=19200, XMIT=PIN_A5
// fixed output mode
#use fixed_io(A_outputs =PIN_A1,PIN_A2)
/*
PIN_A1 : BLUE
*/
//Global variable
int             count=0;
int                     led_count=0;
//DATA
struct{
                float   y[6];
                float   avr[4];
                float   gap[3];
} Y_DATA;
```

-continued

```
// vibration motor start timing function
long Set_Vib_Tim(long AD_DATA){
                        return (1023-AD_DATA);
}
void RESET( ){
    int i;
    for(i = 0 ; i<5 ; i++){
        Y_DATA.y[i] = Y_DATA.y[i+1];
    }
    count =4;
}
// great change
int FLAG_BIG_CHANGE( ) {
    float gap;
    gap = Y_DATA.gap[1] + Y_DATA.gap[0];
    if(gap <= 0){
        if(gap < -20 && gap > -35){
            return 1;
        }else if(gap <= -35) {
            // super change
            return 10;
        }else {
            return 255;
        }
    }else if(gap > 0){
```

-continued

```
        // Inversion of acceleration becoming it very much
        if(gap > 20 && gap < 35){
            return 2;
        }else if(gap >= 35) {
            // super change
            return 20;
        }else{
            return 255;
        }
            }
            return 0;
}
void START_Motor(long count_Tim){
        long i;
        for(i = 0 ; i < count_Tim ; i++){
            delay_ms(1);
        }
        output_high(PIN_A2);
}
void STOP_Motor(void){
        delay_ms(1000);
        output_low(PIN_A2);
}
void DOWN_FLAG_LED(int l_count,long TTim){
        if(1_count ==1){
            //printf("BLUE,");
            output_high(PIN_A1);//BLUE
            //delay_ms(1) TTim call it in a time
            // vibration motor operation start
            START_Motor(TTim);
            STOP_Motor( );
            output_low(PIN_A1);
            led_count = 2;
        }
}
void AVERAGE( ){
                int i;
                for(i = 0 ; i <4 ;i++){
                        Y_DATA.avr[i] = (Y_DATA.y[i] +
Y_DATA.y[i+1] + Y_DATA.y[i+2])/3;
                }
}
void GAP( ){
            int i;
            for(i =0 ; i <3 ; i++){
                Y_DATA.gap[i] = Y_DATA.avr[i+1] −
                Y_DATA.avr[i];
            }
}
void START_OR_ERR( ){
            //Error processing or time of a start
            int i;
        for(i=0;i<5;i++){
                output_high(PIN_A1);
                delay_ms(100);
                output_low(PIN_A1);
                delay_ms(100);
        }
}
// main program
void main( ) {
            // variable definition
            float       Input_Y;
            int         af;
            int         flag;
            int         GREEN_FLAG;
            long Variable_Data,Tim;
start:
            // Initialization
            led_count = 0;
            af = 0;
            flag = 0;
            GREEN_FLAG = 0;
            // clock frequency change
            setup_oscillator(OSC_8MHZ);
            // A/D Converter initial setting AN0
            setup_adc_ports(AN0_ANALOG && AN3_ANALOG);
            setup_adc(ADC_CLOCK_DIV_8);
            output_low(PIN_A1 && PIN_A2);
            delay_ms(500);
```

-continued

```
            START_OR_ERR( );
            //Timing setting
            set_adc_channel(3);
            Variable_Data = read_adc( );
            Tim = Set_Vib_Tim(Variable_Data);
            // main loop Y-axis
            while(1){
                set_adc_channel(0);
                Input_Y = read_adc( );
                Y_DATA.y[count] = Input_Y;
                if(count < 5){
                    //nothing
                }else if(count == 5){
                    // Average
                    AVERAGE( );
                    // Two points
                    GAP( );
                    if(af == 1) {
                        goto AFTER_Point;
                    }
                // initial point
                // initial point filter
                // first step
                if(Y_DATA.gap[0] <= 0 && Y_DATA.gap[1] <= 0
&& Y_DATA.gap[2] <= 0) {
                // second step
                if((Y_DATA.gap[0] + Y_DATA.gap[1] +
Y_DATA.gap[2]) < −20){
                        // During minus number acceleration
increase
                        af =1;
            AFTER_Point:
                        / / After an initial point
                        // distinction of the domain
                        flag = FLAG_BIG_CHANGE( );
                        if(flag == 1){//DOWN
                            DOWN_FLAG_LED(1
ed_count,Tim);
                            if(led_count==2){
                                goto
start;
                            }1
                            led_count = 0;
                        } else if(flag == 2) {//UP
                            led_count++;
                        }else if(flag == 0){
                            // nothing
                            af = 0;
                        }else if(flag == 10) {
                            DOWN_FLAG_LED(led
_count,Tim);
                        if(led_count==2){
                            goto start;
                        }
                            led_count =0;
                        } else if(flag == 20){
                            led_count++;
                        }else {//flag == 255
                            // status quo
                        }
                }else {//noise
                }
            }else{
            }
            RESET( );
        }else {
        // error or count = 0
        }
        count++;
}
}
        END
```

The invention claimed is:

1. A start timing instructing device for informing a player of a body start timing for downswing in a golf swing, the device comprising:

a sensor attachable to a wrist or a waist of the player and configured to detect changes in angle and acceleration associated with a backswing movement of the player;

a microprocessor configured to (i) set and adjust a predetermined start timing associated with a predetermined angle and acceleration data, (ii) identify a top position of the backswing movement based on the angle and acceleration data detected by the sensor, and (iii) generate a start timing instruction based on comparison between the predetermined angle and acceleration data and the detected angle and acceleration data; and a stimulator attachable to the player and configured to generate a vibration, sound or electric stimulation upon receiving the start timing instruction from the microprocessor to inform the player of the body start timing for the downswing, wherein the predetermined start timing is adjustable with the microprocessor so as to instruct the player to start the body movement toward the downswing at a timing immediately before the detected backswing movement reaches at the identified top position, and wherein the microprocessor is configured to execute the following computer program list (A), (B) or (C):

(A) computer program list for a control using an angular velocity sensor

Angular Velocity Sensor of lower limbs attached file

```
    LIST P=12F683
    INCLUDE "P12F683.inc"
    _CONFIG_INTRC_OSC_NOCLKOUT &_WDT_OFF
&_PWRTE_OFF &
_MCLRE_OFF &_CP_OFF &_CPD_OFF &_BOD_OFF
&_IESO_OFF &_FCMEN_OFF
;
;                    definition of the fixed number
;
W           EQU     0       ;
F           EQU     1       ;
C           EQU     0       ;
bit0        EQU     0       ;
bitl        EQU     1       ;
bit2        EQU     2       ;
bit3        EQU     3       ;
bit4        EQU     4       ;
bit5        EQU     5       ;
bit6        EQU     6       ;
bit7        EQU     7       ;
;
;------- PIC established register definition --------
;INDF       EQU     H'00'   ;
;FSR        EQU     H'04'   ;
;;OPTION_REG         EQU     H'01' ;Option Register
;PCL        EQU     H'02'   ;
;STATUS              EQU     H'03'           ;
;GPIO       EQU     H'05'   ;
;;TRISIO             EQU     H'05'           ;
;PCLATH              EQU     H'0A'           ;
;INTCON              EQU     H'0B'           ;
;PIR1       EQU     H'0C'   ;
;TMR1L               EQU     H'0E'           ;
;TMR1H               EQU     H'0F'           ;
; T1CON               EQU     H'10'           ;
;;PIE1       EQU     H'0C'   ;
;;PCON               EQU     H'0B'           ;
;;OSCCON             EQU     H'0F'           ;
;;OSCTUNE            EQU     H'10'           ;
;;ADRESL             EQU     H'1E'           ;
;ADRESH              EQU     H'1E'           ;
;ADCON0              EQU     H'1F'           ;
; ;ANSEL              EQU     H'1F'           ;
;
```

-continued

```
;-------- general-purpose register definition --------
saveW       EQU     H'20'   ;
saveS       EQU     H'21'   ;
BZ_onT              EQU     H'22' ;
Timer1      EQU     H'23'   ;
Timer2      EQU     H'24'   ;
RegA        EQU     H'25'   ;
RegB        EQU     H'26'   ;
RegC        EQU     H'27'   ;
RegD        EQU     H'28'   ;
REF         EQU     H'29'   ;
DL          EQU     H'2A'   ;
DH          EQU     H'2B'   ;
AL          EQU     H'2C'   ;
OutBuf              EQU     H'2D' ;
FLAG        EQU     H'2E'   ;
                            ; bit0---
                            ; bit1---
                            ; bit2---
                            ; bit3---
                            ; bit4---
                            ; bits---
                            ; bit6---
                            ; bit7---
;
;                   I/O
;
;Vss ---- power supply, input and output COM Pin8
;bit 0--- program Data       Pin7(Input)
;bit 1--- program Clock      Pin6(Input)
;bit 2--- Angle setting input        Pin5(Input)
;bit 3--- program Vpp               Pin4(Input)
;bit 4--- angular velocity sensor Pin3(Input)
;bit 5--- buzzer                    Pin2(output)
;Vdd            ---- power supply       Pin1
;
;               start addressing of the program
    ORG  h'0000'            ;PIC
        GOTO INITIAL                            ;
;
;               work to interrupt it ( 8mSec)
        ORG             h'0004'         ;
;------- save of the register -------------
        MOVWF           saveW           ;save W into saveW
        SWAPF           STATUS,W        ;
        MOVWF           saveS           ;save STATUS into
                                        saveS
;------ AD Channel discrimination -----------
        BTFSC           OutBuf,bit5     ;
        GOTO Tdec           ; on Tdec
;===== angular velocity value uptake addition save ======
        MOVFADRESH,W ;
        MOVWF           AL              ;
        SKPNZ                           ;
        GOTO INT0           ;
        MOVLW           d'5'            ;
        SUBWF           AL,W            ;AL-5
        SKPNC                           ;AL<5
        GOTO INT1           ;
;------ angular velocity value <=10 ---------
INT0
        CLRF DL             ;
        CLRF DH             ;
        CLRF FLAG           ;
;*****
        MOVLW           b'00001001'     ;
        MOVWF           ADCON0              ; set point uptake start
        CALL u_WAIT                     ;
        BSF             ADCON0,GO   ;AD START
        BTFSC           ADCON0,NOT_DONE
        GOTO $-1
        MOVFADRESH,W ;
        MOVWF           REF             ;
        MOVLW           b'00001101'     ;
        CALL u_WAIT                     ;
        BSF             ADCON0,GO   ;AD START
;       MOVLW           b'00001111'     ;
;       MOVWF           ADCON0          ;
;*****
        GOTO            Iret            ;
```

-continued

```
;------- angular velocity value >10 -------
INT1
        BTFSC           FLAG,bit0       ;
        GOTO INT2           ;
        MOVF AL ,W          ;
        ADDWF           DL,F            ;
        SKPNC                           ;
        INCF DH             ;
        ADDWF           DL,F            ;
        SKPNC               ;
        INCF DH             ;
        ADDWF           DL,F            ;
        SKPNC                           ;
        INCF DH             ;
        ADDWF           DL,F            ;
        SKPNC                           ;
        INCF DH             ; 4 times
        MOVF DH,W           ;
        SUBWF           REF,W               ;REF - DH
        SKPC                ;
        GOTO INT3           ;REF < DH
INT2    MOVLW           b'00001111'     ;
        MOVWF           ADCON0              ;
        GOTO Iret           ;
;---- It turns to a setting angle ------
INT3
        BSF OutBuf,bit5     ;
        MOVF OutBuf,W     ;
        MOVWF           GPIO            ; buzzer on
        MOVLW           d'20'           ;
        MOVWF           Timer1          ; buzzer on
        CLRF DL             ;
        CLRF DH             ;
        BSF             FLAG,bit0       ;
        GOTO Iret           ;
;-------- Timer ----------
Tdec
        MOVF Timer1,F     ;
        SKPZ                ;
        DECF Timer1,F     ;
;------- Return processing -------
Iret
        BCF     INTCON,bit2     ;TMR0
        SWAPF           saveS,W         ;
        MOVWF           STATUS          ;return STATUS
                                        from saveS
        SWAPF           saveW,F         ;
        SWAPF           saveW,W         ;return W from saveW
        RETFIE
;
;                           Initial setting
    ORG H'080'              ;
INITIAL
        MOVLW           b'00000000'     ;GPIO prohibit the
                                        unsettled output
        MOVWF           GPIO            ; write in it before
        BSF         STATUS,bit5 ; Register bank 1
        MOVLW           b'11011111'     ;
        MOVWF           TRISIO              ;GPS output, input
                                            mode
        MOVLW           b'1000100'      ;
        MOVWF           OPTION_REG          ;PULL UP
                                            Unavailable,
                                            TMR0 1/32
        MOVLW           b'01100001'     ;
        MOVWF           OSCCON              ;4M Hz
        MOVLW           b'00001100'     ;
        MOVWF           ANSEL               ;AD Fosc/2, AN2,
                                        AN3
                                            Analog_Port
        BCF     STATUS,bit5 ; register bank 0
        MOVLW           b'00001001'     ; set it to a port
        MOVWF           ADCON0              ;Left justified,
                                            Ref_Vdd, AN2,
conversion start
        CLRF FLAG           ;
CLRF OutBuf                             ;
;------- Initial set point uptake -------
        CALL M_WAIT     ;
;       MOVLW           b'00001011'     ;
```

-continued

```
;       MOVWF           ADCON0              ;
;       CALL M_WAIT                     ;
;       MOVF ADRESH,W ;
        MOVLW           0FFH            ;W register MAX set
        MOVWF           REF             ;
;-------- angular velocity uptake start --------
        MOVLW           b'00001101'
        MOVWF           ADCON0              ; reshuffling
        CALL M_WAIT                     ;
        MOVLW           b'00001111'     ;
        MOVWF           ADCON0              ; uptake start
;------- TMR0 Interrupt permission --------
        MOVLW           b'10100000'     ;
        MOVWF           INTCON          ;TMR0 Interrupt
                                        permission
;
;                           Main routine
MAIN
        BTFSSGPIO,bit5    ;
        GOTO MAIN           ;
        MOVF Timer1,F     ;
        SKPZ                ;
        GOTO $-2            ;
        BCF OutBuf,bit5   ;
        MOVF OutBuf,W     ;
        MOVWF           GPIO            ; off
        GOTO MAIN           ;
;
;                           Idling
M_WAIT
        MOVLW           d'250'          ;
        MOVWF           RegB            ;
        MOVLW           d'249'          ;
        MOVWF           RegA            ;
        NOP                 ;
        DECFSZ          RegA,F              ;
        GOTO $-2            ;
        DECFSZ          RegB,F          ;T = (RegB)X1 mSec
        GOTO $-6            ;
        RETURN                          ;
u_WAIT                          ;AD
        GOTO $+1
        GOTO $+1
        GOTO $+1
        GOTO $+1
        GOTO $+1
        GOTO $+1
        GOTO $+1
        GOTO $+1
        GOTO $+1
        GOTO $+1
        RETURN
          END;
```

(B) computer program list for a control using an acceleration sensor

Acceleration Sensor of lower limbs attached file

```
      LIST P=12F683
    INCLUDE "P 12F683.inc"
    _CONFIG _INTRC_OSC_ NOCLKOUT &_WDT_OFF
&_PWRTE_OFF &
_MCLRE_OFF &_CP_OFF &_CPD_OFF &_BOD_OFF
&_IESO_OFF &_FCMEN_OFF
;           definition of the fixed number
W           EQU         0           ; working register
F           EQU         1           ; origin of transfer
C           EQU         0           ; carry flag
bit0        EQU         0           ;
bitl        EQU         1           ;
bit2        EQU         2           ;
bit3        EQU         3           ;
bit4        EQU         4           ;
bit5        EQU         5           ;
bit6        EQU         6           ;
bit7        EQU         7           ;
```

-continued

```
;--- PIC definition of the established register---
;INDF        EQU         H'00'       ; Indirect addressing
;FSR         EQU         H'04'       ; address pointer
;;OPTION_REG             EQU    H'01'      ;Option_Register
;PCL         EQU         H'02' ;low-ranking
;STATUS      EQU         H'03'       ; status register
;GPIO EQU    H'05'       ; I/O port
;;TRISIO     EQU         H'05'       ; designated register
;PCLATH      EQU         H'0A'       ; high-ranking parttimer
;INTCON      EQU         H'0B'       ;Interrupt control flag
                                     group register
;PIR1 EQU    H'0C'       ; Interrupt control flag group register
;TMR1L       EQU         H'0E'       ;
;TMR1H       EQU         H'0F'       ;
;T1CON       EQU         H'10'       ;
;;PIE1 EQU   H'0C'       ;
;;PCON       EQU         H'0B' ;
;;OSCCON     EQU         H'0F'       ;setting register oinside
                                     oscillation
; ;OSCTUNE EQU           H'10'       ; adjustment register
;;ADRESL     EQU         H'1E'       ;AD Conversion input
                                     data L
;ADRESH      EQU         H'1E'       ;AD Conversion input
                                     data H
;ADCON0      EQU         H'1F'       ;AD conversion control
                                     register
;;ANSEL      EQU         H'1F'       ; adjustment register
;
;-------- definition of general-purpose register ------
cblock H'20'
saveW       ;
saveS       ;
BZ_onT                  ;
Timer1      ;
Timer2      ;
RegA        ; general-purpose register A
RegB        ; general-purpose register B
RegC        ; general-purpose register C
RegD        ; general-purpose register D
RegE        ; general-purpose register E
REF                     ; acceleration set point
DL                      ; Acceleration value L
DH                      ; Acceleration value H
AL                      ;SNS
AH                      ;SNS
AL_n1                   ; last time SNS
OutBuf                  ; buffer for output
FLAG        ; flag register
                        ; bit0--- flag impossible of a re-start
                        ; bit1---
                        ; bit2---
                        ; bit3---
                        ; bit4---
                        ; bits---
                        ; bit6---
                        ; bit7---
endc
;           I/O layout of the port
;
;Vss ----COM Pin8(power supply)
;bit 0--- Data      Pin7(Input)
;bit 1--- Clock     Pin6(Input)
;bit 2---           Pin5(Input)
;bit 3--- Vpp       Pin4(Input)
;bit 4---           Pin3(Input)
;bit 5---          Pin2(output)
;Vdd ----                Pin1(power supply)
;
;           start addressing of the program
;
        ORG         h'0000'     ;PIC
        GOTO INITIAL ;
;
;                   work to interrupt it (8mSec)
;
        ORG         h'0004'     ;
;--------- save of the register ---------------
        MOVWF       saveW       ;save W into saveW
        SWAPF       STATUS,W    ;
        MOVWF       saveS       ;save STATUS into
```

-continued

```
                                        saveS
;--------- AD Channel discrimination----------------
        BTFSC       OutBuf,bit5     ;
        GOTO Tdec       ;
        BTFSC       FLAG,bit1       ;
        GOTO Tdec       ;
;===== acceleration value uptake addition save ==========
        MOVF ADRESH,W ;sns
;       movwf RegE      ; keep it at one time
        ADDWF       AL_n1,F         ;SNS+ This time
        BCF         STATUS,C        ;C Flg CLR
        RRF         AL_n1,F         ;1/2
        MOVFAL_n1,W     ;
        MOVWF       AL              ;
        SKPNZ                       ;
        GOTO INT0   ;
        MOVLW       d'20'           ;
        SUBWF       AL,W            ;AL-20
        SKPNC                           ;AL<20
        GOTO INT1   ;
;----- Acceleration value <-20 --------
INT0
        BTFSC       FLAG,bit2       ; During multiplication
        GOTO INT1   ; multiplication continuation
        CLRF DL     ; Acceleration L
        CLRF DH     ; Acceleration H
        CLRF FLAG   ; Acceleration 0 start again
;*****
;       MOVLW       b'00001101'     ;VR
;       MOVWF       ADCON0          ; set point uptake
                                        start
;       CALL u_WAIT                 ; Waiting
;       BSF         ADCON0,GO ;AD START
;       BTFSC       ADCON0,NOT_DONE
;       GOTO $-1
;       MOVFADRESH,W ; Acceleration setting input
;       MOVWF       REF             ; save a set point
        MOVLW       b'00001001'     ;SNS
        CALL u_WAIT                 ;
        BSF         ADCON0,GO ;AD START
;       MOVLW       b'00001011'     ;
;       MOVWF       ADCON0          ; acceleration uptake
                                    start
;*****
        GOTO        Iret            ;
;------ Acceleration value >10 -------
INT1
        BTFSC       FLAG,bit0       ;
        GOTO INT2   ;
;       MOVF AL,W   ;
; Revision
        RRF         AL,F            ;/2
        MOVLW       25              ;0.3V
        ADDWF       AL,F
;
        CLRF AH
        BCF         STATUS,C        ;C Flg CLR
        RLF         AL,F
        RLF         AH,F
        RLF         AL,F
        RLF         AH,F
        RLF         AL,F
        RLF         AH,F
;       RLF         AL,F
;       RLF         AH,F
;       BCF         STATUS,C        ;C Flg CLR
;       RLF         AL,F
;       RLF         AH,F
        movf    AL,W
        addwf   DL,F
        btfsc STATUS,C ;3h,0
        incf    DH,F
        movf    AH,W
        addwf   DH,F
;       ADDWF       DL,F            ;
;       SKPNC                       ;
;       INCF    DH  ;
;       ADDWF       DL,F            ;
;       SKPNC                       ;
;       INCF    DH  ;
```

-continued

```
;
;           ADDWF       DL,F        ;
;           SKPNC                   ;
;           INCF    DH      ;
;
;           ADDWF       DL,F        ;
;           SKPNC                   ;
;           INCF    DH      ; 4 times
            MOVF DH,W ;
            SUBWF       REF,W       ;REF - DH
            SKPC        ;
            GOTO INT3   ;REF < DH
            NOP
            NOP
            MOVLW       d'8'        ;
            SUBWF       DH,W        ;DH-8
            SKPNC                   ;DH<8
            GOTO INT2   ;
            BSF         FLAG,bit2   ; During multiplication
INT2        MOVLW       b'00001011' ;SNS
            MOVWF       ADCON0      ; acceleration uptake
                                    start
            GOTO Iret   ;
;----- It turns to setting acceleration ------
INT3
            BSF         OutBuf,bit5 ;
            MOVF OutBuf,W           ;
            MOVWF       GPIO        ; on
            MOVLW       d'20'       ;
            MOVWF       Timer1      ; on
            CLRF DL       ; Acceleration L
            CLRF DH       ; Acceleration H
            BSF FLAG,bit0 ;
            BSF FLAG,bit1 ;
            BCF FLAG,bit2 ;
            GOTO Iret   ;
;------- Timer Subtraction -----------
Tdec
            MOVFTimer 1,F ;
            SKPZ        ;
            DECFTimer1,F ;
;------- Return processing -------------
Iret
            BCF INTCON,bit2 ;TMR0
            SWAPF       saveS,W     ;
            MOVWF       STATUS      ;return STATUS from
                                    saveS
            SWAPF       saveW,F     ;
            SWAPF       saveW,W     ;return W from saveW
            RETFIE
;
;                           Initial setting
            ORG         H'080'      ;
INITIAL
            MOVLW       b'00000000' ;GPIO prohibit the
                                    unsettled output
            MOVWF       GPIO        ; write it before setting
            BSF         STATUS,bit5 ; Register bank 1
            MOVLW       b'11011111' ;
            MOVWF       TRISIO      ;GPS output, input
                                     mode
            MOVLW       b'1000100'  ;
            MOVWF       OPTION_REG  ;PULL_UP
                                     Unavailable,
                                     TMR0 1/32
            MOVLW       b'01100001' ;
            MOVWF       OSCCON      ;4M Hz
            MOVLW       b'00001100' ;
            MOVWF       ANSEL       ;AD Fosc/2, AN2,
                                     AN3 Analog_Port
            BCF     STATUS,bit5 ; correct a register bank to 0
            MOVLW       b'00001101' ;
            MOVWF       ADCON0      ;Left justified,
                                     Ref_Vdd, AN2,
conversion start
            CLRF FLAG   ;
            CLRF OutBuf             ;
;------ Initial set point uptake -------------
            CALL M_WAIT             ;
            MOVLW       b'00001111' ;
```

-continued

```
            MOVWF       ADCON0      ; set point uptake
                                    start
            CALL M_WAIT             ;
            MOVF ADRESH,W ;
;           MOVLW       0FFH        ;W MAX
            MOVWF       REF         ; save a set point
;------- acceleration uptake start -------------
            MOVLW       b'00001001' ;
            MOVWF       ADCON0      ; Reshuffling
            CALL M_WAIT ;
            MOVLW       b'00001011' ;
            MOVWF       ADCON0      ; start
;--------- TMR0 Interrupt permission --------
            MOVLW       b'10100000' ;
            MOVWF       INTCON      ;TMR0
;           Main routine
MAIN
            BTFSSGPIO,bit5 ;
            GOTO MAIN       ;
            MOVFTimerl,F ;
            SKPZ            ;
            GOTO $-2        ;
            BCF OutBuf,bit5 ;
            MOVF OutBuf,W ;
            MOVWF           GPIO        ; off
            MOVLW           d'250'      ;
            MOVWF           Timer1      ;
            MOVFTimer1,F    ;
            SKPZ            ;
            GOTO $-2        ;
            BCF     FLAG,bitl           ; re-start is possible
            GOTO            MAIN        ;
;
;                           Idling
M_WAIT
            MOVLW           d'250'      ;
            MOVWF           RegB        ;
            MOVLW           d'249'      ;
            MOVWF           RegA        ;
            NOP                 ;
            DECFSZ          RegA,F      ;
            GOTO $-2            ;
            DECFSZ          RegB,F      ;T = (RegB)X1 mSec
            GOTO $-6            ;
            RETURN              ;
u_WAIT                      ;AD   u s
            GOTO $+1
            GOTO $+1
            GOTO $+1
            GOTO $+1
            GOTO $+1
            GOTO $+1
            GOTO $+1
            GOTO $+1
            GOTO $+1
            GOTO $+1
            GOTO $+1
            GOTO $+1
            GOTO $+1
            RETURN
              END;
```

(C) computer program list for a control using an acceleration sensor

Acceleration Sensor of lower limbs Attached file

```
// Header file include
#include <12f683.h>
#DEVICE ADC=10
// Configuration setting
#fuses INTRC_IO, NOWDT, PUT, NOPROTECT, NOMCLR
#use delay(CLOCK = 8000000)
#use RS232(BAUD=19200, XMIT=PIN_A5)
// fixed output mode
#use fixed_io(A_outputs = PIN_A1,PIN_A2)
/*
```

-continued

```
PIN_A1: BLUE
*/
//Global variable
int        count=0;
int                    led_count=0;
//DATA
struct{
        float y[6];
        float avr[4];
        float gap[3];
} Y_DATA;
// vibration motor start timing function
long Set_Vib_Tim(long AD_DATA){
                return (1023-AD_DATA);
}
void RESET( ){
                int i;
                for(i = 0 ; i<5; i++){
                        Y_DATA.y[i] = Y_DATA.y[i+];
                }
                count =4;
}
// great change
int FLAG_BIG_CHANGE( ){
                float gap;
                gap = Y_DATA.gap[1] + Y_DATA.gap[0]
                if(gap <= 0){
                        if(gap < −20 && gap > −35){
                                return 1;
                        }else if(gap <= −35) {
                                // super change
                                return 10;
                        }else{
                                return 255;
                        }
                }else if(gap > 0){
                        // Inversion of acceleration
                         becoming it very much
                        if(gap > 20 && gap < 35){
                                return 2;
                        }else if(gap >= 35) {
                                // super change
                                return 20;
                        }else{
                                return 255;
                        }
                }
                return 0;
}
void START_Motor(long count_Tim){
        long i;
        for(i = 0 ; i < count_Tim ; i++){
                delay_ms(1);
        }
        output_high(PIN_A2);
}
void STOP_Motor(void){
        delay_ms(1000);
        output_low(PIN_A2);
}
void DOWN_FLAG_LED(int 1_count,long TTim){
        if(1_count ==1){
                //printf("BLUE,");
                output_high(PIN_A1);//BLUE
                //delay_ms(1) TTim call it in a time
                // vibration motor operation start
                START_Motor(TTim);
                STOP_Motor( );
                output_low(PIN_A1);
                led_count = 2;
        }
}
void AVERAGE( ){
        int i;
        for(i = 0 ; i < 4 ;i++){
                Y_DATA.avr[i] = (Y_DATA.y[i] +
Y_DATA.y[i+1] + Y_DATA.y[i+2])/3;
        }
}
void GAP( ){
```

-continued

```
        int             i;
        for(i = 0 ; i < 3 ; i++){
                Y_DATA.gap[i] = Y_DATA.avr[i+1] −
Y_DATA.avr[i];
        }
}
void START_OR_ERR( ){
        //Error processing or time of a start
        int i;
        for(0=i;i<5;i++){
                output_high(PIN_A1);
                delay_ms(100);
                output_low(PIN_A1);
                delay_ms(100);
        }
}
// main program
void main( ) {
        // variable definition
        float        Input_Y;
        int                af;
        int                flag;
        int                GREEN_FLAG;
        long Variable_Data,Tim;
start:
        // Initialization
        led_count = 0;
        af = 0;
        flag = 0;
        GREEN_FLAG = 0;
        // clock frequency change
        setup_oscillator(OSC_8MHZ);
        // A/D Converter initial setting AN0
        setup_adc_ports(AN0_ANALOG && AN3_ANALOG);
        setup_adc(ADC_CLOCK_DIV_8);
        output_low(PIN_A1 && PIN_A2);
        delay_ms(500);
        START_OR_ERR( );
        //Timing setting
        set_adc_channel(3);
        Variable_Data = read_adc( );
        Tim = Set_Vib_Tim(Variable_Data);
        // main loop Y-axis
        while(1){
          set_adc_channel(0);
          Input _Y = read_adc( );
          Y_DATA.y[count] = Input_Y;
          if(count < 5){
                //nothing
          }else if(count == 5){
                // Average
                AVERAGE( );
                // Two points
                GAP( );
                if(af = 1){
                        goto AFTER_Point;
                }
          // initial point
          // initial point filter
          // first step
          if(Y_DATA.gap[0] <= 0 && Y_DATA.gap[1] <= 0
          && Y_DATA.gap[2]
<= 0){
            // second step
            if((Y_DATA.gap[0] + Y_DATA.gap[1] +
              Y_DATA.gap[2]) < -
20){
                // During minus number acceleration
                  increase af = 1;
          AFTER_Point:
                // After an initial point
                // distinction of the domain
                flag = FLAG_BIG_CHANGE( );
                if(flag == 1) {//DOWN
                        DOWN_FLAG_LED
                        (led_count,Ti
m);
                    if(led_count==2){
                        goto start;
                    }l
```

-continued

```
                    led_count = 0;
                }else if(flag == 2){//UP
                    led_count++;
                }else if(flag == 0){
                    // nothing
                    af = 0;
                }else if(flag == 10){
                    DOWN_FLAG_LED(led_count,Tim)
                    if(led_count==2){
                            goto start;
                    }
                    led_count =0;
                }else if(flag == 20){
                      led_count++;
                }else{//flag == 255
                    // status quo
            }
                }else {//noise
            }
              }else{
        }
              RESET( );
        }else{
        // error or count = 0
        }
        count++;
    }
    }
        END.
```

2. The downswing start timing instructing device according to claim 1, wherein the sensor comprises at least one of an angle velocity sensor, an acceleration sensor, and an angle and acceleration sensor.

3. The downswing start timing instructing device according to claim 1, wherein the device further comprises a wristwatch-type device attachable to the wrist of the player, and wherein the wristwatch-type device has at least one of an angle velocity sensor, an acceleration sensor, and an angle and acceleration sensor.

4. The downswing start timing instructing device according to claim 1, wherein the stimulator is a vibrator attachable to a thigh of the player to stimulate the thigh with the vibration so as to instruct the player to start the body movement from the lower body of the player.

5. The downswing start timing instructing device according to claim 1, wherein the stimulator receives the start timing instruction from the microprocessor via a wireless communication between the stimulator and the microprocessor.

6. A method of informing a player of a body start timing for downswing in a golf swing, the method comprising:

attaching a sensor to a wrist or a waist of the player to detect changes in angle and acceleration associated with a backswing movement of the player;

setting a predetermined start timing associated with a predetermined angle and acceleration data with microprocessor;

by the microprocessor, identifying a top position of the backswing movement based on the angle and acceleration data detected by the sensor;

by the microprocessor, generating a start timing instruction based on comparison between the predetermined angle and acceleration data and the detected angle and acceleration data;

attaching a stimulator to the player;

by the microprocessor, controlling the stimulator to generate a vibration, sound or electric stimulation upon receiving the start timing instruction to inform the player of the body start timing for the downswing, and adjusting the predetermined start timing so as to instruct the player to start the body movement toward the downswing at a timing immediately before the detected backswing movement reaches at the identified top position, wherein the method comprises executing the following computer program list (A), (B) or (C):

(A) computer program list for a control using an angular velocity sensor

Angular Velocity Sensor of lower limbs attached file

```
    LIST P=12F683
    INCLUDE "P12F683.inc"
    __CONFIG_INTRC_OSC_NOCLKOUT &_WDT_OFF &_PWRTE_OFF &
_MCLRE_OFF &_CP_OFF &_CPD_OFF &_BOD_OFF &_IESO_OFF &_FCMEN_OFF
;
;   definition of the fixed number
;
W       EQU     0       ;
F       EQU     1       ;
C       EQU     0       ;
bit0    EQU     0       ;
bit1    EQU     1       ;
bit2    EQU     2       ;
bit3    EQU     3       ;
bit4    EQU     4       ;
bit5    EQU     5       ;
bit6    EQU     6       ;
bit7    EQU     7       ;
;
;---------- PIC established register definition ----------
;INDF EQU        H'00'   ;
;FSR EQU         H'04'   ;
;;OPTION_REG              EQU     H'01'   ;Option_Register
;PCL EQU         H'02'   ;
;STATUS          EQU     H'03'   ;
;GPIO EQU        H'05'   ;
;;TRISIO          EQU     H'05'   ;
;PCLATH          EQU     H'0A'   ;
;INTCON          EQU     H'0B'   ;
;PIR1 EQU        H'0C'   ;
;TMR1L           EQU     H'0E'   ;
;TMR1H           EQU     H'0F'   ;
```

-continued

```
; T1CON                    EQU          H'10'          ;
;;PIE1 EQU                 H'0C'        ;
;;PCON                    EQU          H'0B'          ;
;;OSCCON                  EQU          H'0F'          ;
;;OSCTUNE                 EQU          H'10'          ;
;;ADRESL                  EQU          H'1E'          ;
;ADRESH                   EQU          H'1E'          ;
;ADCON0                   EQU          H'1F'          ;
;;ANSEL                   EQU          H'1F'          ;
;
;--------- general-purpose register definition ----------
saveW     EQU             H'20'                ;
saveS     EQU             H'21'                ;
BZ_onT                    EQU                  H'22'              ;
Timer1    EQU             H'23'                ;
Timer2    EQU             H'24'                ;
RegA      EQU             H'25'                ;
RegB      EQU             H'26'                ;
RegC      EQU             H'27'                ;
RegD      EQU             H'28'                ;
REF       EQU             H'29'                ;
DL        EQU             H'2A'                ;
DH        EQU             H'2B'                ;
AL        EQU             H'2C'                ;
OutBuf                    EQU                  H'2D' ;
FLAG        EQU           H'2E'                ;
                                               ; bit0---
                                               ; bit1---
                                               ; bit2---
                                               ; bit3---
                                               ; bit4---
                                               ; bit5---
                                               ; bit6---
                                               ; bit7---
;
;                         I/O
;
;Vss ---- power supply, input and output COM Pin8
;bit 0--- program Data                Pin7(Input)
;bit 1--- program Clock               Pin6(Input)
;bit 2--- Angle setting input         Pin5(Input)
;bit 3--- program Vpp                 Pin4(Input)
;bit 4--- angular velocity sensor     Pin3(Input)
;bit 5--- buzzer                      Pin2(output)
;Vdd ---- power supply                     Pin 1
;
;              start addressing of the program
  ORG                     h'0000'              ;PIC
    GOTO INITIAL                                   ;
;
;          work to interrupt it ( 8mSec)
    ORG                   h'0004'              ;
;---------- save of the register ----------------
    MOVWF                 saveW                                  ;save W into saveW
    SWAPF                 STATUS,W                               ;
    MOVWF                 saveS                                  ;save STATUS into saveS
;---------- AD Channel discrimination ------------
    BTFSC                 OutBuf,bit5          ;
    GOTO Tdec                     ; on Tdec
;====== angular velocity value uptake addition save =======
    MOVF ADRESH,W ;
    MOVWF                 AL                   ;
    SKPNZ                                      ;
    GOTO INT0                     ;
    MOVLW                 d'5'                 ;
    SUBWF                 AL,W                 ;AL-5
    SKPNC                                      ;AL<5
    GOTO INT1                     ;
;----- angular velocity value <= 10 --------
INT0
     CLRF DL                      ;
     CLRF DH                      ;
     CLRF FLAG                    ;
;*****
     MOVLW                b'00001001'          ;
     MOVWF                ADCON0                                 ; set point uptake start
     CALL u_WAIT                                ;
     BSF                  ADCON0,GO ;AD START
     BTFSC                ADCON0,NOT_DONE
     GOTO $-1
```

-continued

```
        MOVF ADRESH,W ;
        MOVWF           REF             ;
        MOVLW           b'00001101'     ;
        CALL u_WAIT                     ;
        BSF             ADCON0,GO ;AD START
;       MOVLW           b'00001111'     ;
;       MOVWF           ADCON0                  ;
;*****
        GOTO            Iret            ;
;------ angular velocity value >10 -------
INT1
        BTFSC                           FLAG,bit0       ;
        GOTO INT2                       ;
        MOVF AL ,W                      ;
        ADDWF           DL,F                            ;
        SKPNC                                           ;
        INCF   DH                       ;
        ADDWF           DL,F                            ;
        SKPNC                                           ;
        INCF   DH                       ;
        ADDWF           DL,F                            ;
        SKPNC                                           ;
        INCF   DH                       ;
        ADDWF           DL,F                            ;
        SKPNC                                           ;
        INCF   DH                       ; 4 times
        MOVF DH,W                       ;
        SUBWF           REF,W                           ;REF - DH
        SKPC                            ;
        GOTO INT3                       ;REF < DH
INT2 MOVLW      b'00001111'             ;
        MOVWF           ADCON0                                  ;
        GOTO Iret                       ;
;---- It turns to a setting angle -----
INT3
        BSF    OutBuf,bit5              ;
        MOVF OutBuf,W                   ;
        MOVWF           GPIO                            ; buzzer on
        MOVLW           d'20'                           ;
        MOVWF           Timer1                          ; buzzer on
        CLRF DL                         ;
        CLRF DH                         ;
        BSF    FLAG,bit0                ;
        GOTO Iret                       ;
;---------- Timer -------------
Tdec
        MOVF Timer1,F                   ;
        SKPZ                            ;
        DECF Timer1,F                   ;
;---------- Return processing --------------
Iret
        BCF INTCON,bit2 ;TMR0
        SWAPF           saveS,W         ;
        MOVWF           STATUS          ;return STATUS from saveS
        SWAPF           saveW,F         ;
        SWAPF           saveW,W         ;return W from saveW
        RETFIE
;
;                               Initial setting
        ORG             H'080'          ;
INITIAL
        MOVLW           b'00000000'     ;GPIO prohibit the unsettled output
        MOVWF           GPIO            ; write in it before
        BSF     STATUS,bit5     ; Register bank 1
        MOVLW           b'11011111'     ;
        MOVWF           TRISIO                          ;GP5 output, input mode
        MOVLW           b'1000100'      ;
        MOVWF           OPTION_REG                      ;PULL_UP Unavailable, TMR0 1/32
        MOVLW           b'01100001'     ;
        MOVWF           OSCCON                          ;4M Hz
        MOVLW           b'00001100'     ;
        MOVWF           ANSEL                           ;AD Fosc/2, AN2,AN3 Analog_Port
        BCF     STATUS,bit5 ;   register bank 0
        MOVLW           b'00001001'     ; set it to a port
        MOVWF           ADCON0          ;Left justified, Ref_Vdd, AN2,
conversion start
        CLRF FLAG                       ;
        CLRF OutBuf                     ;
;--------- Initial set point uptake ------------
        CALL M_WAIT                     ;
```

-continued

```
;       MOVLW                   b'00001011'     ;
;       MOVWF                   ADCON0                  ;
;       CALL M_WAIT                             ;
;       MOVF ADRESH,W                   ;
        MOVLW                   0FFH            ;W register MAX set
        MOVWF                   REF             ;
;--------- angular velocity uptake start ------------
        MOVLW                   b'00001101'     ;
        MOVWF                   ADCON0                  ; reshuffling
        CALL M_WAIT                             ;
        MOVLW                   b'00001111'     ;
        MOVWF                   ADCON0                  ; uptake start
;-------- TMR0 Interrupt permission ------------
        MOVLW                   b'10100000'     ;
        MOVWF                   INTCON                  ;TMR0 Interrupt permission
;
;                                       Main routine
MAIN
        BTFSSGPIO,bit5                  ;
        GOTO MAIN                       ;
        MOVF Timer1,F                   ;
        SKPZ                            ;
        GOTO $-2                        ;
        BCF OutBuf,bit5
        MOVF OutBuf,W
        MOVWF                   GPIO            ; off
        GOTO MAIN                       ;
;                               Idling
M_WAIT
        MOVLW                   d'250'          ;
        MOVWF                   RegB            ;
        MOVLW                   d'249'          ;
        MOVWF                   RegA            ;
        NOP                             ;
        DECFSZ                  RegA,F                  ;
        GOTO $-2                        ;
        DECFSZ                  RegB,F                  ;T =(RegB) X1 mSec
        GOTO $-6                        ;
        RETURN                          ;
u_WAIT                          ;AD
        GOTO $+1
        GOTO $+1
        GOTO $+1
        GOTO $+1
        GOTO $+1
        GOTO $+1
        GOTO $+1
        GOTO $+1
        GOTO $+1
        GOTO $+1
        RETURN
          END;
```

(B) computer program list for a control using an acceleration sensor

Acceleration Sensor of lower limbs attached file

```
            LIST    P=12F683
        INCLUDE         "P12F683.inc"
        __CONFIG_INTRC_OSC_NOCLKOUT &_WDT_OFF &_PWRTE OFF &
_MCLRE_OFF &_CP_OFF &_CPD_OFF &_BOD_OFF &_IESO_OFF &_FCMEN_OFF
;       definition of the fixed number
W               EQU     0               ; working register
F               EQU     1               ; origin of transfer
C               EQU     0               ; carry flag
bit0            EQU     0               ;
bit1            EQU     1               ;
bit2            EQU     2               ;
bit3            EQU     3               ;
bit4            EQU     4               ;
bit5            EQU     5               ;
bit6            EQU     6               ;
bit7            EQU     7               ;
```

-continued

```
;--- PIC definition of the established register---
;INDF        EQU     H'00'     ; Indirect addressing
;FSR         EQU     H'04'     ; address pointer
;;OPTION_REG                   EQU H'01'   ;Option_Register
;PCL         EQU     H'02'     ;low-ranking
;STATUS      EQU     H'03'     ; status register
;GPIO EQU    H'05'     ; I/O port
;;TRISIO     EQU     H'05'     ; designated register
;PCLATH      EQU     H'0A'     ; high-ranking parttimer
;INTCON      EQU     H'0B'     ; Interrupt control flag group register
;PIR1   EQU  H'0C'     ; Interrupt control flag group register
;TMR1L       EQU     H'0E'     ;
;TMR1H       EQU     H'0F      ;
;T1CON       EQU     H'10'     ;
;;PIE1   EQU  H'0C'     ;
;PCON        EQU     H'0B'     ;
;OSCCON      EQU     H'0F'     ;setting register oinside oscillation
;OSCTUNE     EQU     H'10'     ; adjustment register
;;ADRESL     EQU     H'lE'     ;AD Conversion input data L
;ADRESH      EQU     H'1E'     ;AD Conversion input data H
;ADCON0      EQU     H'1F'     ;AD conversion control register
;;ANSEL      EQU     H'1F'     ; adjustment register
;
;------ definition of general-purpose register ----------
cblock H'20'
saveW       ;
saveS       ;
BZ_onT                ;
Timer1      ;
Timer2      ;
RegA        ; general-purpose register A
RegB        ; general-purpose register B
RegC        ; general-purpose register C
RegD        ; general-purpose register D
RegE        ; general-purpose register E
REF                   ; acceleration set point
DL                    ; Acceleration value L
DH                    ; Acceleration value H
AL                    ;SNS
AH                    ;SNS
AL_nl       ; last time SNS
OutBuf                ; buffer for output
FLAG        ; flag register
                      ; bit0---- flag impossible of a re-start
                      ; bit1----
                      ; bit2----
                      ; bit3----
                      ; bit4----
                      ; bit5----
                      ; bit6----
                      ; bit7----
endc
;           I/O layout of the port
;
;Vss ----COM   Pin8(power supply)
;bit 0---Data      Pin7(Input)
;bit 1---Clock     Pin6(Input)
;bit 2---            Pin5(Input)
;bit 3---Vpp       Pin4(Input)
;bit 4---            Pin3(Input)
;bit 5---         Pin2(output)
;Vdd ----                Pin1(power supply)
;
;           start addressing of the program
;
    ORG h'0000'     ;PIC
      GOTO INITIAL            ;
;
;           work to interrupt it (8mSec)
;
      ORG h'0004'   ;
; ---------- save of the register----------------
    MOVWF           saveW           ;save W into saveW
    SWAPF           STATUS.W        ;
    MOVWF           saveS           ;save STATUS into saveS
; ---------- AD Channel discrimination----------------
    BTFSC           OutBuf.bit5     ;
    GOTO Tdec               ;
    BTFSC           FLAG.bit1       ;
    GOTO Tdec               ;
```

-continued

```
;====== acceleration value uptake addition save ==========
        MOVF ADRESH.W           ;sns
;       movwf RegE              ; keep it at one time
        ADDWF       AL_n1,F                         ;SNS+ This time
        BCF         STATUS.C                ;C Fig CLR
        RRF         AL_n1,F                         ;1/2
        MOVFAL_n1.W                                 ;
        MOVWF       AL                              ;
        SKPNZ                                       ;
        GOTO INT0               ;
        MOVLW       d'20'                           ;
        SUBWF       AL,W                    ;AL-20
        SKPNC                                       ;AL<20
        GOTO INT1               ;
;-----Acceleration value <=20 --------
INT0
        BTFSC           FLAG,bit2                   ; During multiplication
        GOTO INT1               ; multiplication continuation
        CLRF DL                 ; Acceleration L
        CLRF DH                 ; Acceleration H
        CLRF FLAG               ; Acceleration 0 start again
;*****
;       MOVLW                   b'00001101'         ;VR
;       MOVWF                   ADCON0                      ; set point uptake start
;       CALL u_WAIT                                 ; Waiting
;       BSF                     ADCON0,GO           ;AD START
;       BTFSC                   ADCON0,NOT_DONE
;       GOTO $-1
;       MOVFADRESH,W                    ; Acceleration setting input
;       MOVWF                   REF                 ; save a set point
        MOVLW                   b'00001001'         ;SNS
        CALL u_WAIT                                 ;
        BSF                     ADCON0,GO           ;AD START
;       MOVLW                   b'00001011'         ;
;       MOVWF                   ADCON0                  ; acceleration uptake start
;*****
        GOTO                    Iret                ;
;------Acceleration value >10 -------
INT1
        BTFSC       FLAG.bit0                       ;
        GOTO INT2               ;
;       MOVFAL,W                ;
; Revision
        RRF         AL,F                            ;/2
        MOVLW       25                                  ;0.3V
        ADDWF                   AL.F
;
        CLRF AH
        BCF                     STATUS,C            ;C FlgCLR
        RLF                     AL,F
        RLF                     AH,F
        RLF                     AL,F
        RLF                     AH,F
        RLF                     AL,F
        RLF                     AH,F
;       RLF                     AL,F
;       RLF                     AH,F
;       BCF                     STATUS,C            ;C FlgCLR
;       RLF                     AL,F
;       RLF                     AH,F
        movf        AL,W
        addwf       DL,F
        btfsc       STATUS,C                ;3h,0
        incf        DH.F
        movf        AH.W
        addwf       DH.F
;       ADDWF                   DL,F                ;
;       SKPNC                                       ;
;       INCF DH                                 ;
;       ADDWF                   DL,F                ;
;       SKPNC                                       ;
;       INCF DH                                 ;
;       ADDWF                   DL,F                ;
;       SKPNC                                       ;
;       INCF DH                                 ;
;       ADDWF                   DL,F                ;
;       SKPNC                                       ;
;       INCF DH                                 ; 4 times
;
        MOVFDH.W                                ;
```

-continued

```
        SUBWF           REF,W                   ;REF - DH
        SKPC                    ;
        GOTO INT3               ;REF < DH
        NOP
        NOP
        MOVLW           d'8'            ;
        SUBWF           DH,W            ;DH-8
        SKPNC                           ;DH<8
        GOTO INT2               ;
        BSF FLAG,bit2           ; During multiplication
INT2 MOVLW              b'0000101 1'    ; SNS
        MOVWF           ADCON0          ; acceleration uptake start
        GOTO Iret               ;
;---- It turns to setting acceleration -----
INT3
        BSF OutBuf.bit5         ;
        MOVFOutBuf,W            ;
        MOVWF           GPIO            ; on
        MOVLW           d'20'           ;
        MOVWF           Timer1          ; on
        CLRF DL                 ; Acceleration L
        CLRF DH                 ; Acceleration H
        BSF FLAG.bit0           ;
        BSF FLAG.bit1           ;
        BCF FLAG.bit2           ;
        GOTO Iret               ;
; ----------Timer Subtraction ----------
Tdec
        MOVFTimer1,F            ;
        SKPZ                    ;
        DECF Timer1,F           ;
; ---------- Return processing ----------
Iret
        BCF     INTCON,bit2 ;TMR0
        SWAPF           saveS,W         ;
        MOVWF           STATUS          ;return STATUS from saveS
        SWAPF           saveW,F
        SWAPF           saveW,W         ;return W from saveW
;
;               Initial setting
        ORG     H'080           ;
INITIAL
        MOVLW           b'00000000'     ;GPIO prohibit the unsettled output
        MOVWF           GPIO            ; write it before setting
        BSF     STATUS,bit5 ; Register bank 1
        MOVLW           b'1000100'      ;
        MOVWF           TRISIO          ;GP5 output, input mode
        MOVLW           b'1000100'      ;
        MOVWF           OPTION_REG      ;PULL_UP Unavailable, TMR0 1/32
        MOVLW           b'01100001'     ;
        MOVWF           OSCCON          ;4M Hz
        MOVLW           b'00001100'     ;
        MOVWF           ANSEL           ;AD Fosc/2, AN2, AN3 Analog_Port
        BCF     STATUS,bit5 ; correct a register bank to 0
        MOVLW           b'01100001'     ;
        MOVWF           ADCON0          ;Left justified, Rcf_Vdd, AN2,
conversion start
        CLRF FLAG               ;
        CLRF OutBuf             ;
; --------- Initial set point uptake ----------
        CALL M_WAIT             ;
        MOVLW           b'00001111'     ;
        MOVWF           ADCON0          ; set point uptake start
        CALL M_WAIT             ;
        MOVFADRESH.W ;
;       MOVLW           0FFH            ;W MAX
        MOVWF           REF             ; save a set point
;--------- acceleration uptake start ----------
        MOVLW           b'00001001'     ;
        MOVWF           ADCON0          ; Reshuffling
        CALL M_WAIT             ;
        MOVLW           b'00001011'     ;
        MOVWF           ADCON0          ; start
;--------- TMR0 Interrupt permission ----------
        MOVLW           b'10100000'     ;
        MOVWF           INTCON          ;TMR0
;                       Main routine
MAIN
        BTFSSGPIO,bitS          ;
        GOTO MAIN               ;
```

-continued

```
        MOVFTimer1,F                    ;
        SKPZ                            ;
        GOTO $-2                        ;
        BCF OutBuf,bit5                 ;
        MOVFOutBuf,W                    ;
        MOVWF           GPIO                    ; off
        MOVLW           d'250'                  ;
        MOVWF           Timer1                  ;
        MOVFTimer1,F                    ;
        SKPZ                            ;
        GOTO $-2                        ;
        BCF FLAG,bit1                   ; re-start is possible
        GOTO            MAIN                    ;
;
;                       Idling
M_WAIT
        MOVLW           d'250'                  ;
        MOVWF           RegB                    ;
        MOVLW           d'249'                  ;
        MOVWF           RegA                    ;
        NOP                             ;
        DECFSZ          RegA,F                          ;
        GOTO $-2                        ;
        DECFSZ          RegB,F                          ;T = (RegB)X1 mSec
        GOTO $-6                        ;
        RETURN                                          ;
u_WAIT                  ;AD     u s
        GOTO $+1
        GOTO $+1
        GOTO $+1
        GOTO $+1
        GOTO $+1
        GOTO $+1
        GOTO $+1
        GOTO $+1
        GOTO $+1
        GOTO $+1
        GOTO $+1
        GOTO $+1
        GOTO $+1
        RETURN
            END;
```

(C) computer program list for a control using an acceleration sensor

Acceleration Sensor of lower limbs Attached file

```
// Header file include
#include <12f683.h>
#DEVICE ADC=10
// Configuration setting
#fuses      INTRC_IO, NOWDT, PUT, NOPROTECT, NOMCLR
#use delay(CLOCK = 8000000)
#use RS232(BAUD=19200, XMIT=PIN_A5)
// fixed output mode
#use fixed_io(A_outputs =PIN_A1,PIN_A2)
/*
PIN_A1: BLUE
*/
//Global variable
int     count=0;
int         led_count=0;
//DATA
struct{
        float   y[6];
        float   avr[4];
        float   gap[3];
}Y_DATA;
// vibration motor start timing function
long Set_Vib_Tim(long AD_DATA){
        return (1023-AD_DATA);
}
void RESET( ) {
        int i;
        for(i = 0 ; i<5; i++){
```

-continued

```
            Y_DATA.y[i] = Y_DATA.y[i+1];
        }
        count =4;
    }
    // great change
    int FLAG_BIG_CHANGE( ){
        float gap;
        gap = Y_DATA.gap[1] + Y_DATA.gap[0];
        if(gap <= 0){
            if(gap < −20 && gap > −35){
                return 1;
            }else if(gap <= −35) {
                // super change
                return 10;
            }else {
                return 255;
            }
        }else if(gap > 0){
            // Inversion of acceleration becoming it very much
            if(gap > 20 && gap < 35){
                return 2;
            }else if(gap >= 35) {
                // super change
                return 20;
            }else{
                return 255;
            }
        }
        return 0;
    }
    void START_Motor(long count_Tim){
        long i;
```

-continued

```
        for(i = 0 ; i < count_Tim ; i++){
            delay_ms(1);
        }
        output_high(PIN_A2);
}
void STOP_Motor(void){
        delay_ms(1000);
        output_low(PIN_A2);
}
void DOWN_FLAG_LED(int 1_count,long TTim){
        if(1_count ==1){
            //printf("BLUE,");
            output_high(PIN_A1);//BLUE
            //delay_ms(1) TTim call it in a time
            // vibration motor operation start
            START_Motor(TTim);
            STOP_Motor( );
            output_low(PIN_A1);
            led_count = 2;
        }
}
void AVERAGE( ){
        int i;
        for(i = 0 ; i < 4 ;i++){
            Y_DATA.avr[i] = (Y_DATA.y[i] + Y_DATA.y[i+1] +
Y_DATA.y[i+2])/3;
        }
}
void GAP( ){
        int     i;
        for(i = 0 ; i < 3 ; i++){
            Y_DATA.gap[i] = Y_DATA.avr[i+1] – Y_DATA.avr[i];
        }
}
void START_OR_ERR( ){
        //Error processing or time of a start
        int i;
    for(i=0;i<5;i++){
            output_high(PIN_A1);
            delay_ms(100);
            output_low(PIN_A1);
            delay_ms(100);
    }
}
// main program
void main( ){
    // variable definition
    float     Input Y;
    int             af;
    int             flag;
    int             GREEN_FLAG;
    long Variable_ Data,Tim;
start:
    // Initialization
    led_count = 0;
    af = 0;
    flag = 0;
    GREEN_FLAG = 0;
    // clock frequency change
    setup_oscillator(OSC_8MHZ);
    // A/D Converter initial setting AN0
    setup_adc_ports(AN0_ANALOG && AN3_ANALOG);
    setup_adc(ADC_CLOCK_DIV_8);
    output_low(PIN_A1 && PIN_A2);
    delay_ms(500);
    START_OR_ERR( );
    //Timing setting
    set_adc_channel(3);
    Variable_Data = read_adc( );
    Tim = Set_Vib_Tim(Variable_Data);
    // main loop Y-axis
    while(1){
        set_adc_channel(0);
        Input_Y = read_adc( );
        Y_DATA.y[count] = Input_Y;
            if(count < 5){
                //nothing
            }else if(count == 5){
```

-continued

```
            // Average
            AVERAGE( );
            // Two points
            GAP( );
            if(af == 1){
                goto AFTER_Point;
            }
        // initial point
        // initial point filter
        // first step
        if(Y_ DATA.gap[0] <= 0 && Y_DATA.gap[1] <= 0 &&
            Y_DATA.gap[2]
<= 0){
            // second step
            if((Y DATA.gap[0] + Y_DATA.gap[1] +
                Y_DATA.gap[2]) <-
20){
                // During minus number acceleration increase
                af = 1;
        AFTER_Point:
                // After an initial point
                // distinction of the domain
                flag = FLAG_BIG_CHANGE( );
                if(flag == 1) {//DOWN
                        DOWN_FLAG_LED(led_count,Ti
m);
                    if(led_count==2){
                            goto start;
                    }1
                    led_count = 0;
                }else if(flag ==2) {//UP
                    led_count++;
                }else if(flag == 0){
                    // nothing
                    af = 0;
                }else if(flag == 10){
                    DOWN_FLAG_LED(led_count,Tim)
;
                    if(led_count ==2){
                        goto start;
                    }
                    led_count = 0;
                }else if(flag == 20){
                    led_count++;
                }else {//flag == 255
                        // status quo
                }
                    }else {//noise
        }
            }else {
    }
            RESET( );
    }else {
    // error or count = 0
    }
    count++;
}
}
    END.
```

7. The method according to claim 6, wherein the sensor comprises at least one of an angle velocity sensor, an acceleration sensor, and an angle and acceleration sensor and wherein the sensor is attached to the player.

8. The method according to claim 6, wherein the sensor is attached to the wrist of the player.

9. The method according to claim 6, wherein the stimulator is attached to a thigh of the player to stimulate the thigh with the vibration so as to start the body movement from the lower body of the player.

10. The method according to claim 6, wherein the start timing instruction is sent to the stimulator via a wireless communication.

* * * * *